US012233303B2

(12) United States Patent
Pritchett

(10) Patent No.: US 12,233,303 B2
(45) Date of Patent: Feb. 25, 2025

(54) CARRIAGE ASSEMBLY AND WEIGHTLIFTING ASSEMBLY INCLUDING A CARRIAGE ASSEMBLY

(71) Applicant: Coulter Ventures, LLC., Columbus, OH (US)

(72) Inventor: Martin Pritchett, Columbus, OH (US)

(73) Assignee: Coulter Ventures, LLC., Columbus, OH (US)

( * ) Notice: Subject to any disclaimer, the term of this patent is extended or adjusted under 35 U.S.C. 154(b) by 47 days.

(21) Appl. No.: 17/826,747

(22) Filed: May 27, 2022

(65) Prior Publication Data

US 2022/0379157 A1 Dec. 1, 2022

Related U.S. Application Data

(60) Provisional application No. 63/193,923, filed on May 27, 2021.

(51) Int. Cl.
*A63B 21/062* (2006.01)

(52) U.S. Cl.
CPC ..... *A63B 21/0626* (2015.10); *A63B 2225/09* (2013.01)

(58) Field of Classification Search
CPC ..... A63B 21/0616; A63B 17/00; A63B 21/06; A63B 21/0615; A63B 21/0626;
(Continued)

(56) References Cited

U.S. PATENT DOCUMENTS 325,435 A 9/1885 North
723,625 A 3/1903 Thornley
(Continued)

FOREIGN PATENT DOCUMENTS

CA 3113232 A1 3/2020
CN 113784762 A 12/2021
(Continued)

OTHER PUBLICATIONS

Oct. 11, 2022—(WO) ISR and WO—App PCT/US2022/031299.
(Continued)

*Primary Examiner* — Loan B Jimenez
*Assistant Examiner* — Andrew M Kobylarz
(74) *Attorney, Agent, or Firm* — Banner & Witcoff, Ltd.

(57) ABSTRACT

An adjustable carriage assembly includes a carriage defining a passage configured to receive a frame member therethrough such that the carriage is moveable along the frame member, and a locking structure configured for engaging the frame member to lock the carriage in position relative to the frame member. The locking structure includes a main pin and an auxiliary pin connected to the carriage that are each moveable between a locked position, where the respective pin extends into the passage and is configured to engage the frame member to lock the carriage in position, and an unlocked position, where the respective pin is retracted from the passage and is configured to disengage from the frame member. The carriage may also include a first portion and a second portion, where a space is defined between the first and second portions, and the second portion is adjustable with respect to the first portion.

31 Claims, 25 Drawing Sheets

(58) Field of Classification Search
CPC ... A63B 21/0628; A63B 21/078; A63B 21/08; A63B 21/16; A63B 21/4035; A63B 23/035; A63B 23/03508; A63B 21/055; A63B 21/0552; A63B 21/065; A63B 21/0724; A63B 21/0783; A63B 23/03541; A63B 23/03558; A63B 23/04; A63B 2023/0411; A63B 2225/093
See application file for complete search history.

(56) References Cited

U.S. PATENT DOCUMENTS

| | | | |
|---|---|---|---|
| 2,067,403 | A | 1/1937 | Lea |
| 2,476,863 | A | 7/1949 | Hawes |
| 3,716,231 | A | 2/1973 | Martin |
| 4,286,782 | A | 9/1981 | Fuhrhop |
| 4,339,125 | A | 7/1982 | Uyeda et al. |
| 4,456,246 | A | 6/1984 | Szabo |
| 4,492,375 | A | 1/1985 | Connelly |
| 4,582,320 | A | 4/1986 | Shaw |
| 4,634,127 | A | 1/1987 | Rockwell |
| 4,635,934 | A | 1/1987 | Roethke |
| 4,697,809 | A | 10/1987 | Rockwell |
| 4,856,775 | A | 8/1989 | Colledge et al. |
| 4,955,604 | A | 9/1990 | Pogue |
| 4,974,838 | A | 12/1990 | Sollenberger |
| 5,050,868 | A | 9/1991 | Pearson |
| 5,116,297 | A | 5/1992 | Stonecipher |
| 5,135,453 | A | 8/1992 | Sollenberger |
| 5,184,992 | A | 2/1993 | Banks |
| 5,195,937 | A | 3/1993 | Engel et al. |
| 5,242,344 | A | 9/1993 | Hundley |
| D358,623 | S | 5/1995 | Macasieb |
| 5,529,558 | A | 6/1996 | Koenig |
| 5,554,083 | A | 9/1996 | Chen |
| 5,554,085 | A | 9/1996 | Dalebout |
| 5,569,133 | A | 10/1996 | Vittone |
| 5,570,957 | A | 11/1996 | Kuly et al. |
| 5,688,216 | A | 11/1997 | Mauriello |
| 5,722,922 | A | 3/1998 | Watterson et al. |
| 5,800,321 | A | 9/1998 | Webber |
| 5,971,897 | A | 10/1999 | Olson et al. |
| D439,292 | S | 3/2001 | Webber et al. |
| 6,217,483 | B1 | 4/2001 | Kallassy |
| 6,238,323 | B1 | 5/2001 | Simonson |
| 6,261,205 | B1 | 7/2001 | Elefson |
| 6,394,935 | B1 | 5/2002 | Lake |
| 6,447,430 | B1 | 9/2002 | Webb et al. |
| 6,482,139 | B1 | 11/2002 | Haag |
| 6,508,743 | B1 | 1/2003 | Fortin |
| 6,527,683 | B2 | 3/2003 | Tolles |
| 6,547,704 | B2 | 4/2003 | Parrillo |
| D489,601 | S | 5/2004 | Meeker |
| 7,070,546 | B1 | 7/2006 | Grasso |
| D550,790 | S | 9/2007 | Staten |
| D550,791 | S | 9/2007 | Rogers et al. |
| D550,792 | S | 9/2007 | Rogers et al. |
| D551,306 | S | 9/2007 | Rogers et al. |
| 7,488,277 | B1 | 2/2009 | Knapp |
| 7,549,950 | B1 | 6/2009 | Lundquist et al. |
| 7,601,105 | B1 | 10/2009 | Gipson, III et al. |
| 7,604,576 | B2 | 10/2009 | Drechsler |
| 7,717,833 | B1 | 5/2010 | Nelson et al. |
| 7,727,129 | B1 | 6/2010 | Goddard |
| 7,736,286 | B2 | 6/2010 | Panaiotov |
| 7,918,771 | B2 | 4/2011 | Rogers et al. |
| 7,922,630 | B1 | 4/2011 | Batca |
| 7,998,037 | B2 | 8/2011 | Luquette |
| 7,998,040 | B2 | 8/2011 | Kram et al. |
| 8,057,368 | B1 | 11/2011 | Lyszczarz |
| 8,096,926 | B1 | 1/2012 | Batca |
| 8,157,713 | B1 | 4/2012 | Siskowic et al. |
| 8,172,733 | B1 | 5/2012 | Batca |
| D666,259 | S | 8/2012 | Garcia |
| 8,337,370 | B2 | 12/2012 | Rogers et al. |
| 8,485,951 | B1 | 7/2013 | Adams |
| D691,865 | S | 10/2013 | Wang |
| 8,550,964 | B2 | 10/2013 | Ish, III et al. |
| D702,530 | S | 4/2014 | Hasegawa |
| 8,827,875 | B2 | 9/2014 | Schiano |
| 8,834,328 | B1 | 9/2014 | Batca |
| 8,926,480 | B2 | 1/2015 | Lyszczarz |
| 9,011,301 | B2 | 4/2015 | Balandis et al. |
| 9,028,381 | B2 | 5/2015 | Mestemaker |
| 9,067,100 | B2 | 6/2015 | Habing |
| 9,119,989 | B1 | 9/2015 | Lagree et al. |
| 9,192,799 | B2 | 11/2015 | Alenaddaf |
| 9,289,638 | B2 | 3/2016 | Towley, III et al. |
| 9,302,139 | B2 | 4/2016 | Habing et al. |
| D761,085 | S | 7/2016 | Cox |
| 9,409,220 | B2 | 8/2016 | Henniger et al. |
| 9,421,413 | B2 | 8/2016 | Staten et al. |
| 9,446,285 | B1 | 9/2016 | Drath et al. |
| D769,991 | S | 10/2016 | Thomas |
| 9,457,220 | B2 | 10/2016 | Olson |
| D772,356 | S | 11/2016 | Gregory |
| D781,452 | S | 3/2017 | Bokros |
| 9,656,116 | B2 | 5/2017 | Giannelli et al. |
| 9,802,075 | B2 | 10/2017 | Gvoich |
| D806,808 | S | 1/2018 | Gregory |
| D808,475 | S | 1/2018 | Meredith et al. |
| D815,305 | S | 4/2018 | Alvarado et al. |
| 10,004,970 | B1 | 6/2018 | Mailander |
| 10,016,646 | B2 | 7/2018 | Butler |
| 10,226,661 | B2 | 3/2019 | Henniger et al. |
| 10,265,572 | B2 | 4/2019 | Bach et al. |
| 10,272,287 | B1 | 4/2019 | Rector |
| D849,160 | S | 5/2019 | Lau |
| D855,720 | S | 8/2019 | Kuka |
| 10,398,928 | B2 | 9/2019 | Perez Gomez |
| D873,935 | S | 1/2020 | Van Den Berg |
| 10,525,301 | B2 | 1/2020 | Hsu |
| D890,271 | S | 7/2020 | Carmichael et al. |
| D890,867 | S | 7/2020 | Carmichael et al. |
| D892,239 | S | 8/2020 | Carmichael et al. |
| D898,136 | S | 10/2020 | Carmichael et al. |
| D898,137 | S | 10/2020 | Carmichael et al. |
| 10,792,535 | B2 | 10/2020 | Chou |
| 10,940,357 | B2 | 3/2021 | Hansen et al. |
| 11,013,945 | B2 | 5/2021 | Sorin et al. |
| 11,058,909 | B2 | 7/2021 | Adams |
| 11,103,738 | B2 | 8/2021 | Sorin et al. |
| 11,110,313 | B2 | 9/2021 | Gore |
| 11,173,337 | B2 * | 11/2021 | Jones ..... A63B 21/0615 |
| D954,864 | S | 6/2022 | Carmichael et al. |
| D954,867 | S | 6/2022 | Carmichael et al. |
| D955,511 | S | 6/2022 | Carmichael et al. |
| D974,504 | S | 1/2023 | Gong |
| D974,506 | S | 1/2023 | Qi |
| 11,712,597 | B2 * | 8/2023 | Carlson ..... A63B 17/02 482/94 |
| 11,724,147 | B2 | 8/2023 | Sorin et al. |
| 11,731,000 | B2 | 8/2023 | Beecroft et al. |
| 11,801,414 | B2 | 10/2023 | Sorin et al. |
| D1,006,154 | S | 11/2023 | Mao |
| D1,009,188 | S | 12/2023 | Zhang |
| 2003/0115955 | A1 | 6/2003 | Keiser |
| 2003/0134723 | A1 | 7/2003 | Greenland |
| 2003/0192291 | A1 * | 10/2003 | Qicang ..... B65B 11/025 53/390 |
| 2004/0018920 | A1 | 1/2004 | Simonson |
| 2005/0054493 | A1 | 3/2005 | Skilken et al. |
| 2005/0202941 | A1 * | 9/2005 | Vaes ..... A63B 21/0628 482/94 |
| 2006/0035765 | A1 | 2/2006 | Smith |
| 2006/0040799 | A1 | 2/2006 | Pompile |
| 2006/0183607 | A1 | 8/2006 | Collias |
| 2006/0199712 | A1 | 9/2006 | Barnard et al. |
| 2006/0247107 | A1 | 11/2006 | Carter |
| 2006/0252615 | A1 | 11/2006 | Melcer |
| 2007/0037674 | A1 | 2/2007 | Finn et al. |
| 2007/0042876 | A1 | 2/2007 | Lundquist |
| 2007/0054785 | A1 | 3/2007 | Drechsler |
| 2007/0093365 | A1 | 4/2007 | Batca |

(56) References Cited

U.S. PATENT DOCUMENTS

| | | | | |
|---|---|---|---|---|
| 2007/0155595 | A1 | 7/2007 | Rogers et al. | |
| 2007/0155596 | A1 | 7/2007 | Rogers et al. | |
| 2007/0161468 | A1 | 7/2007 | Yanagisawa et al. | |
| 2007/0161472 | A1 | 7/2007 | Drechsler | |
| 2008/0113852 | A1 | 5/2008 | Caldwell | |
| 2009/0143203 | A1 | 6/2009 | Knapp | |
| 2009/0170675 | A1 | 7/2009 | Giannelli et al. | |
| 2010/0016129 | A1 | 1/2010 | Chou | |
| 2010/0137112 | A1 | 6/2010 | Harker | |
| 2010/0216610 | A1 | 8/2010 | Gedeon-Janvier | |
| 2010/0292057 | A1 | 11/2010 | Dunn | |
| 2012/0083392 | A1 | 4/2012 | Taranto | |
| 2012/0289384 | A1 | 11/2012 | Staten et al. | |
| 2012/0329613 | A1 | 12/2012 | Schiano | |
| 2013/0035220 | A1 | 2/2013 | Adams | |
| 2013/0203565 | A1 | 8/2013 | Floyd | |
| 2013/0274075 | A1 | 10/2013 | Habing et al. | |
| 2013/0296143 | A1 | 11/2013 | Staten et al. | |
| 2013/0296146 | A1 | 11/2013 | Staten et al. | |
| 2014/0080685 | A1 | 3/2014 | Butler | |
| 2014/0087928 | A1 | 3/2014 | Luedeka | |
| 2014/0200117 | A1 | 7/2014 | Grider | |
| 2014/0256517 | A1 | 9/2014 | Poppinga | |
| 2014/0296040 | A1 | 10/2014 | Mobley | |
| 2015/0016919 | A1 | 1/2015 | Tambornino et al. | |
| 2015/0051054 | A1 | 2/2015 | Barnhill | |
| 2015/0083681 | A1 | 3/2015 | Childs | |
| 2015/0126335 | A1 | 5/2015 | Gilson et al. | |
| 2015/0141221 | A1 | 5/2015 | Delgado | |
| 2015/0182773 | A1 | 7/2015 | Olson et al. | |
| 2015/0246258 | A1 | 9/2015 | Hockridge | |
| 2015/0290488 | A1 | 10/2015 | Hopperstad et al. | |
| 2015/0352395 | A1 | 12/2015 | Gregory | |
| 2016/0023035 | A1 | 1/2016 | Meyer | |
| 2016/0199691 | A1 | 7/2016 | Hockridge | |
| 2016/0213967 | A1 | 7/2016 | Habing et al. | |
| 2016/0256733 | A1 | 9/2016 | Lagree | |
| 2017/0007877 | A1* | 1/2017 | Leipheimer ..... | A63B 21/4029 |
| 2017/0056705 | A1 | 3/2017 | Zha et al. | |
| 2017/0056707 | A1 | 3/2017 | Hockridge et al. | |
| 2017/0157452 | A1 | 6/2017 | Lagree | |
| 2017/0189736 | A1 | 7/2017 | Martin | |
| 2017/0246496 | A1 | 8/2017 | Nelson et al. | |
| 2017/0246504 | A1 | 8/2017 | Simmons | |
| 2017/0312564 | A1 | 11/2017 | Perez Gomez | |
| 2018/0036573 | A1 | 2/2018 | Lennox et al. | |
| 2018/0185694 | A1 | 7/2018 | Schween | |
| 2018/0200563 | A1 | 7/2018 | Hansen et al. | |
| 2018/0243597 | A1 | 8/2018 | Schlegel | |
| 2019/0099636 | A1 | 4/2019 | Schmidt et al. | |
| 2019/0240521 | A1 | 8/2019 | Staten | |
| 2019/0275363 | A1* | 9/2019 | Jones ..... | A63B 21/0616 |
| 2019/0308061 | A1 | 10/2019 | Murrell et al. | |
| 2019/0336812 | A1 | 11/2019 | Leipheimer | |
| 2020/0038704 | A1 | 2/2020 | Adams | |
| 2020/0078633 | A1 | 3/2020 | Chou | |
| 2020/0139186 | A1 | 5/2020 | Sorin et al. | |
| 2022/0062687 | A1 | 3/2022 | Gao | |
| 2022/0105380 | A1 | 4/2022 | Jones et al. | |
| 2022/0203153 | A1 | 6/2022 | Sergakis et al. | |
| 2023/0099317 | A1 | 3/2023 | Tighe et al. | |
| 2023/0338768 | A1 | 10/2023 | Sorin et al. | |

FOREIGN PATENT DOCUMENTS

| | | | |
|---|---|---|---|
| EP | 2345459 | A1 | 7/2011 |
| EP | 3295998 | A1 | 3/2018 |
| EP | 3852884 | A1 | 7/2021 |
| FR | 2630652 | A1 | 11/1989 |
| GB | 2346808 | A | 8/2000 |
| KR | 200466889 | Y1 | 5/2013 |
| KR | 20140060130 | A | 5/2014 |
| WO | 9842411 | A1 | 10/1998 |
| WO | 2018/093699 | A1 | 5/2018 |
| WO | 2018208772 | A1 | 11/2018 |
| WO | 2020061480 | A1 | 3/2020 |

OTHER PUBLICATIONS

Photo from <https://web.archive.org/web/20170112075250/https://mydynamicfitness.com>, dated Jan. 12, 2017.

Screenshots from <https://www.youtube.com/watch?v=A4xv8OhVbzl>, dated May 17, 2018.

Product promotional materials for Dynamic Fitness Ultra Pro Rack Series from <https://web.archive.org/web/20170112075250/https://mydynamicfitness.com> dated Jan. 12, 2017.

Product listing for Rogue Monster Lever Arms from <https://web.archive.org/web/20160529110340/http://www.roguefitness.com/monster-lever-arms>, dated May 29, 2016.

Product listing for Rogue Monster Lever Arms from <https://web.archive.org/web/20161111082206/http://www.roguefitness.com/monster-lever-arms>, dated Nov. 11, 2016.

Sorinex Exercise Equipment: "Base camp jammer arms adjustable attachment point", Feb. 27, 2018 (Feb. 27, 2018), pp. 1-3, Retrieved from the Internet: URL:https:www.facebook.com/sorinex.strength/videos/base-camp-jammer-arms-adjustable-attachment-point/10158262519208647/.

Jan. 11, 2024—(EP) Rules 161(2) and 162 EPC Communication—App 22812235.4.

Titan Adjustable Monolift Attachment Review—YouTbe; https://www.youtube.com/watch?app=desktop&v=m4aEUEj_xp0; Page uploaded Mar. 8, 2024; 5 pages.

CFF Monster Rig Explosion Arms, from <https://christiansfitnessfactory.com/media/catalog/product/cache/1/image/900x900/0dc2d03fe217f8c83829496872af24a0/m/o/monster_rig_accessory_explsion_arms_loaded.jpg>, believed to be available prior to Mar. 6, 2018.

"Monster Lite LT-1 50 CAL™ Trolley™ 2.0 & Lever Arm Kit" Nov. 2018, Rogue Fitness, site visited Mar. 25, 2024: https://www.roguefitness.com/monster-lite-lt-1-50-cal-trolley-2-0-and-lever-arm-kit?sku= < http://www.roguefitness.com/monster-lite-lt-1-50-cal-trolley-2-0-and-lever-arm-kit?sku=RF0943-BLACK-MG-STANDARO>RF0943-BLACK-MG-ST ANDARO& <http://www.roguefitness.com/monster-lite-lt-1-50-cal-trolley-2-0-and-lever-arm-kit?sku=RF0943-BLACK-MG-STANDARO> gad_source= 1&gelid= EAlalQobCh.

"HRFTS-4000 Builder" Dec. 6, 2017, GETRXD, site visited Mar. 25, 2024: https://www.getrxd.com/hrssft-4000.html <http://www.getrxd.com/hrssft-4000.html>(Year: 2017).

* cited by examiner

CARRIAGE ASSEMBLY AND WEIGHTLIFTING ASSEMBLY INCLUDING A CARRIAGE ASSEMBLY

CROSS-REFERENCE TO RELATED APPLICATIONS

This application is a nonprovisional of, and claims priority to, U.S. Provisional Application No. 63/193,923, filed May 27, 2021, which prior application is incorporated by reference herein in its entirety.

FIELD OF THE INVENTION

This disclosure relates to machines for weightlifting and other exercise, and more specifically to a weightlifting assembly configured to be moveable along a frame member and fixed in a plurality of different positions along the frame member, and weight racks including one or more of such assemblies.

BACKGROUND

Weight racks and other weightlifting equipment often make use of structures that may be mounted at different locations for different exercises, and in particular, at different heights from the ground surface. One example is an articulating arm, which may be placed at different positions and orientations for performing a wide variety of exercises. Moveable and adjustable assemblies for adjusting the mounting height of such equipment exist, but these assemblies suffer from disadvantages such as difficulty of adjustment and inability to support large amounts of weight that are used by dedicated weightlifters. Accessories for such articulating arms are also often found lacking in these and other areas.

The present disclosure is provided to address this need and other needs in existing adjustable assemblies and weight racks including such assemblies. A full discussion of the features and advantages of the present disclosure is deferred to the following detailed description, which proceeds with reference to the accompanying drawings.

BRIEF SUMMARY

Aspects of the disclosure relate to an adjustable carriage assembly that includes a carriage defining a passage configured to receive a frame member therethrough such that the carriage is moveable along the frame member, and a locking structure configured for engaging the frame member to lock the carriage in position relative to the frame member. The locking structure includes a main pin connected to the carriage that is moveable between a locked position, where the main pin extends into the passage and is configured to engage the frame member to lock the carriage in position, and an unlocked position, where the main pin is retracted from the passage and is configured to disengage from the frame member, and an auxiliary pin connected to the carriage that is moveable between a locked position, where the auxiliary pin extends into the passage and is configured to engage the frame member to lock the carriage in position, and an unlocked position, where the auxiliary pin is retracted from the passage and is configured to disengage from the frame member. The main pin has a first engagement member configured to be manipulated by a user to move the main pin between the locked position and the unlocked position, and the auxiliary pin has a second engagement member configured to be manipulated by the user to move the auxiliary pin between the locked position and the unlocked position. The first engagement member is immediately adjacent to the second engagement member, and movement of both the main pin and the auxiliary pin to the unlocked positions allows movement of the carriage with respect to the frame member. At least one of the main pin and the auxiliary pin may be biased toward the locked position.

According to one aspect, the assembly further includes a handle assembly connected to the carriage and comprising a handle configured for gripping by a user.

According to another aspect, the first engagement member is positioned above the second engagement member.

According to a further aspect, the first engagement member has a same shape as the second engagement member when viewed from above.

According to yet another aspect, the assembly further includes a handle assembly connected to the carriage and having a first handle and a second handle configured for gripping by a user, where the first engagement member and the second engagement member are positioned between the first and second handles.

According to a still further aspect, the main pin has a main pin end configured to engage the frame member within the passage, and the auxiliary pin has an auxiliary pin end configured to engage the frame member within the passage, and the auxiliary pin has an offset configuration, such that auxiliary pin end and the main pin end are spaced farther apart than the first engagement member and the second engagement member.

According to an additional aspect the locking structure further includes a first collar piece having a proximal end connected to the carriage and receiving the first pin therethrough and a distal end opposite the proximal end, and a second collar piece connected to the distal end of the first collar piece, the second collar piece having a first opening receiving the first pin therethrough and a second opening receiving the second pin therethrough. In one configuration, the locking structure further includes a first biasing spring engaging the second collar piece and the first pin to bias the first pin toward the locked position, and a second biasing spring engaging the second collar piece and the second pin to bias the second pin toward the locked position.

According to another aspect, the first engagement member has a first pair of grips extending from opposite lateral sides of the first engagement member, and the second engagement member has a second pair of grips extending from opposite lateral sides of the second engagement member. In one configuration, each of the first pair of grips has a recess on a front side thereof, and each of the second pair of grips has a recess on a front side thereof.

Additional aspects of the disclosure relate to an adjustable carriage assembly configured to be adjustably mounted on a vertical, rectangular frame member, having first, second, third, and fourth sides, including a carriage defining a passage configured to receive the frame member therethrough, such that the carriage is moveable along the frame member, and a locking structure configured for engaging the frame member to lock the carriage in position relative to the frame member. The locking structure includes a first pin connected to the carriage that is moveable between a locked position, where the first pin extends into the passage and is configured to be received in a first hole on the first side of the frame member to lock the carriage in position, and an unlocked position, where the first pin is retracted from the passage and is configured to be removed from the first hole, and a second pin connected to the carriage that is moveable between a locked position, where the second pin extends into the passage and is configured to be received in a second hole on the first side of the frame member, located below the first hole, to lock the carriage in position, and an unlocked position, where the second pin is retracted from the passage and is configured to be removed from the second hole. Movement of both the first pin and the second pin to the unlocked positions allows movement of the carriage with respect to the frame member. In one configuration, at least one of the first pin and the second pin is biased toward the locked position.

According to one aspect, the assembly further includes a handle assembly connected to the carriage and having a handle configured for gripping by a user.

According to another aspect, the first pin has a first engagement member configured to be manipulated by a user to move the first pin from the locked position to the unlocked position, and the second pin has a second engagement member configured to be manipulated by the user to move the second pin from the locked position to the unlocked position, and the first engagement member is positioned immediately adjacent to the second engagement member. In one configuration, the first engagement member is positioned above the second engagement member. In another configuration, the first engagement member has a same shape as the second engagement member when viewed from above. In a further configuration, the assembly further includes a handle assembly connected to the carriage and having a first handle and a second handle configured for gripping by a user, where the first engagement member and the second engagement member are positioned between the first and second handles.

According to a further aspect, the first pin has a first engagement member configured to be manipulated by a user to move the first pin from the locked position to the unlocked position, and the second pin has a second engagement member configured to be manipulated by the user to move the second pin from the locked position to the unlocked position. The first pin has a first pin end configured to be received in the first hole, and the second pin has a second pin end configured to be received in the second hole, and the second pin has an offset configuration, such that second pin end and the first pin end are spaced farther apart than the first engagement member and the second engagement member.

According to yet another aspect, the locking structure further includes a first collar piece having a proximal end connected to the carriage and receiving the first pin therethrough and a distal end opposite the proximal end, and a second collar piece connected to the distal end of the first collar piece, the second collar piece having a first opening receiving the first pin therethrough and a second opening receiving the second pin therethrough. In one configuration, the locking structure further includes a first biasing spring engaging the second collar piece and the first pin to bias the first pin toward the locked position, and a second biasing spring engaging the second collar piece and the second pin to bias the second pin toward the locked position.

Further aspects of the disclosure relate to an adjustable carriage assembly that includes a carriage defining a passage configured to receive a frame member therethrough such that the carriage is moveable along the frame member, a handle assembly connected to the carriage and having a first handle configured for gripping by a first hand of a user and a second handle configured for gripping by a second hand of the user, and a locking structure configured for engaging the frame member to lock the carriage in position relative to the frame member. The locking structure includes a main pin connected to the carriage that is moveable between a locked position, where the main pin extends into the passage and is configured to engage the frame member to lock the carriage in position, and an unlocked position, where the main pin is retracted from the passage and is configured to disengage from the frame member, and an auxiliary pin connected to the carriage that is moveable between a locked position, where the auxiliary pin extends into the passage and is configured to engage the frame member to lock the carriage in position, and an unlocked position, where the auxiliary pin is retracted from the passage and is configured to disengage from the frame member. The main pin and the auxiliary pins are biased toward the locked positions. The main pin has a first engagement member configured to be manipulated by a user to move the main pin from the locked position to the unlocked position, and the auxiliary pin has a second engagement member configured to be manipulated by the user to move the auxiliary pin from the locked position to the unlocked position. T the first engagement member and the second engagement member are positioned to be engageable simultaneously by at least one of the first and second hands of the user while the user is gripping the first and second handles, and movement of both the main pin and the auxiliary pin to the unlocked positions allows movement of the carriage with respect to the frame member.

According to one aspect, the first engagement member is positioned immediately adjacent to the second engagement member.

According to another aspect, the first engagement member is positioned above the second engagement member. In one configuration, the first engagement member has a first pair of grips extending from opposite lateral sides of the first engagement member, and the second engagement member has a second pair of grips extending from opposite lateral sides of the second engagement member. In this configuration, each of the first pair of grips has a recess on a front side thereof, and each of the second pair of grips has a recess on a front side thereof. In another configuration, the first engagement member has a same shape as the second engagement member when viewed from above.

According to a further aspect, the locking structure further includes a first collar piece having a proximal end connected to the carriage and receiving the main pin therethrough and a distal end opposite the proximal end, and a second collar piece connected to the distal end of the first collar piece. The second collar piece has a first opening receiving the main pin therethrough and a second opening receiving the auxiliary pin therethrough. In one configuration, the locking structure also includes a first biasing spring engaging the second collar piece and the main pin to bias the main pin toward the locked position, and a second biasing spring engaging the second collar piece and the auxiliary pin to bias the auxiliary pin toward the locked position.

According to yet another aspect, the main pin has a main pin end configured to engage the frame member within the passage, and the auxiliary pin has an auxiliary pin end configured to engage the frame member within the passage, and the auxiliary pin has an offset configuration, such that auxiliary pin end and the main pin end are spaced farther apart than the first engagement member and the second engagement member.

Still further aspects of the disclosure relate to an adjustable carriage assembly configured to be adjustably mounted on a frame member, having opposed first and second sides, including a carriage defining a passage configured to receive the frame member therethrough, such that the carriage is moveable along the frame member. The carriage includes a first portion having a connection structure for connection of an implement, and a second portion positioned adjacent to the first portion, wherein a space is defined between the first portion and the second portion, and the second portion is independently moveable with respect to the first portion. The carriage also includes a first roller connected to the first portion and positioned on a first side of the passage, such that the first roller is configured to engage the first side of the frame member, and a second roller connected to the second portion and positioned on a second side of the passage, such that the second roller is configured to engage the second side of the frame member. The second roller is spaced a distance from the first roller, and the passage is defined between the first roller and the second roller. An adjustment structure is connected to the first portion and the second portion and configured for adjusting the space between the first portion and the second portion to change the distance between the first roller and the second roller. The adjustment structure includes a threaded member configured to adjust the space between the first portion and the second portion by threading engagement.

According to one aspect, the assembly further includes a locking structure configured for engaging the frame member to lock the carriage in position relative to the frame member, and the locking structure includes a retractable pin configured to releasably engage the frame member within the passage.

According to another aspect, the first portion is a front portion including a first pair of parallel side plates spaced laterally from each other, and the second portion is a rear portion including a second pair of parallel side plates spaced laterally from each other. In one configuration, the passage is further defined between at least one of the first pair of parallel side plates and the second pair of parallel side plates.

According to a further aspect, the carriage further includes a third roller connected to the first portion and positioned below the first roller on the first side of the passage, such that the third roller is configured to engage the first side of the frame member, and a fourth roller connected to the second portion and positioned below the second roller on the second side of the passage, such that the fourth roller is configured to engage the second side of the frame member. The fourth roller is spaced a distance from the third roller, and the passage is further defined between the third roller and the fourth roller. The adjustment structure is further configured for adjusting the space between the first portion and the second portion to change the distance between the third roller and the fourth roller.

According to yet another aspect, the assembly further includes a handle assembly connected to the carriage and comprising a handle configured for gripping by a user.

According to a still further aspect, the adjustment structure further includes a first adjustment plate connected to the first portion of the carriage and extending outward from the first portion of the carriage, and a second adjustment plate connected to the second portion of the carriage and extending outward from the second portion of the carriage, parallel to the first adjustment plate. The threaded member is configured to engage the first adjustment plate and the second adjustment plate to adjust the space between the first portion and the second portion by threading engagement. In one configuration, the adjustment structure further includes a first arm fixedly connected to the second adjustment plate and extending across the space between the first portion and the second portion. The first arm is configured for releasable connection to the first portion to fix the first and second portions in a desired position with respect to each other, such that releasing the releasable connection permits adjusting the space between the first portion and the second portion by the adjustment structure. In this configuration, the first adjustment plate may have a passage, where the first arm extends through the passage to connect to the first portion.

According to an additional aspect, the adjustment structure further includes a first arm fixedly connected to one of the first and second portions and extending across the space between the first portion and the second portion. The first arm is configured for releasable connection to the other of the first and second portions to fix the first and second portions in a desired position with respect to each other, such that releasing the releasable connection permits adjusting the space between the first portion and the second portion by the adjustment structure.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
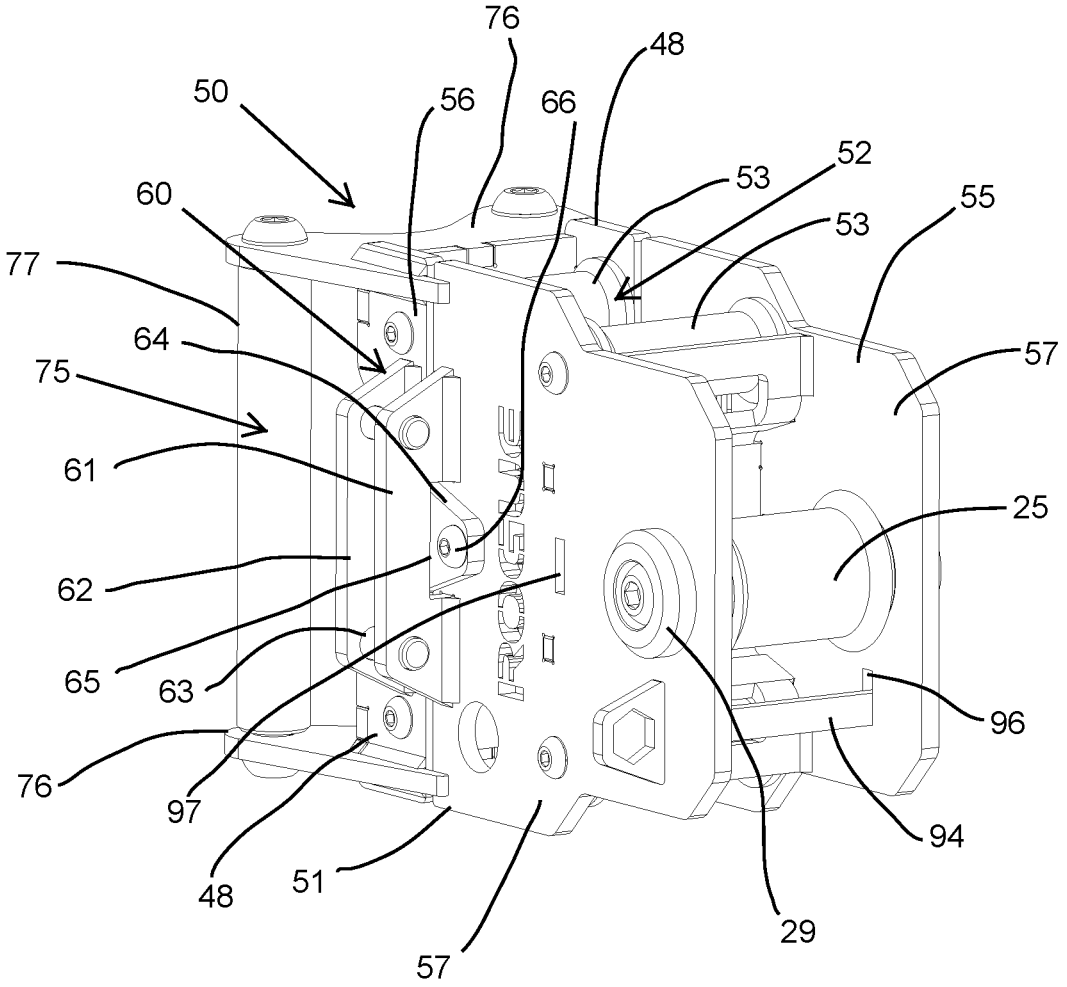
FIG. 1 is a top, front perspective view of one embodiment of a carriage assembly according to aspects of the present disclosure.
Figure 2:
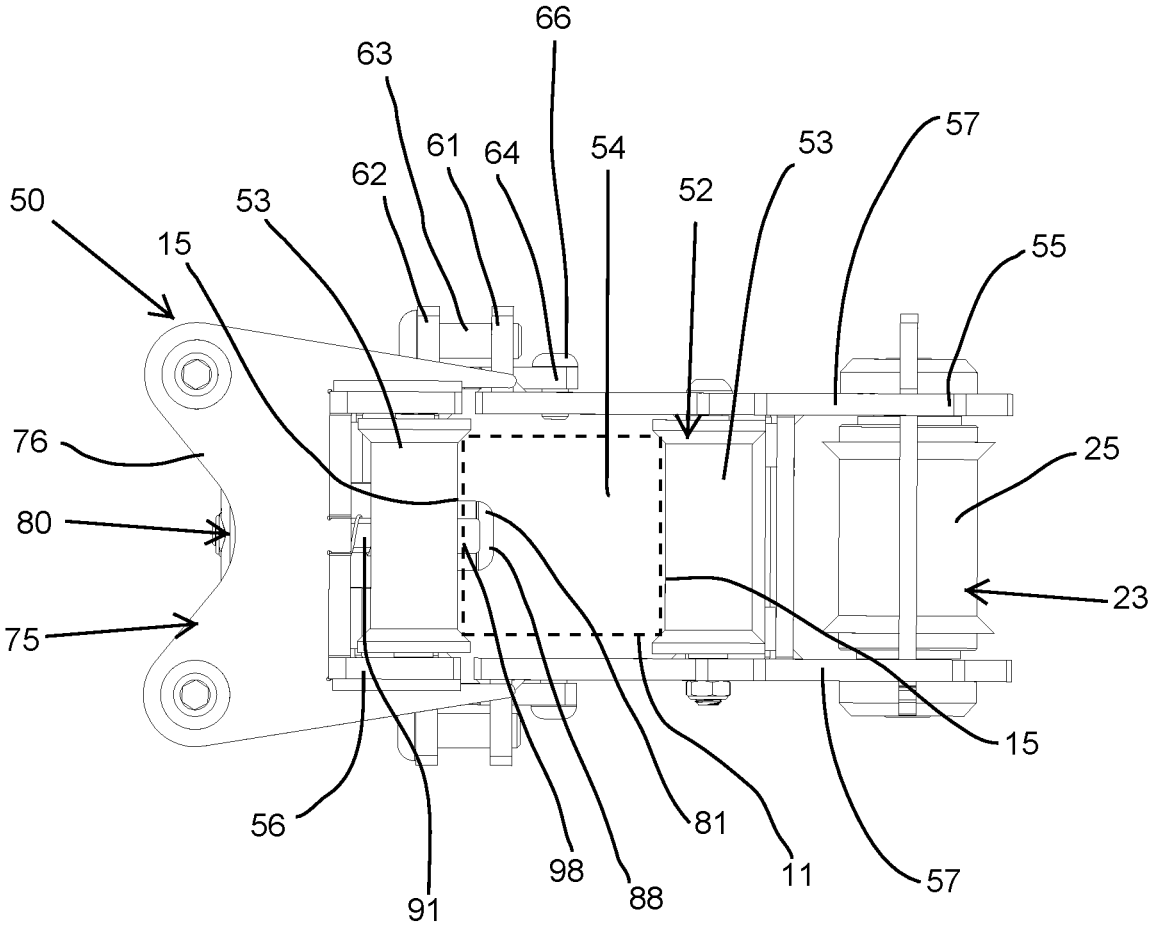
FIG. 2 is a bottom view of the carriage assembly of FIG. 1.
Figure 3:
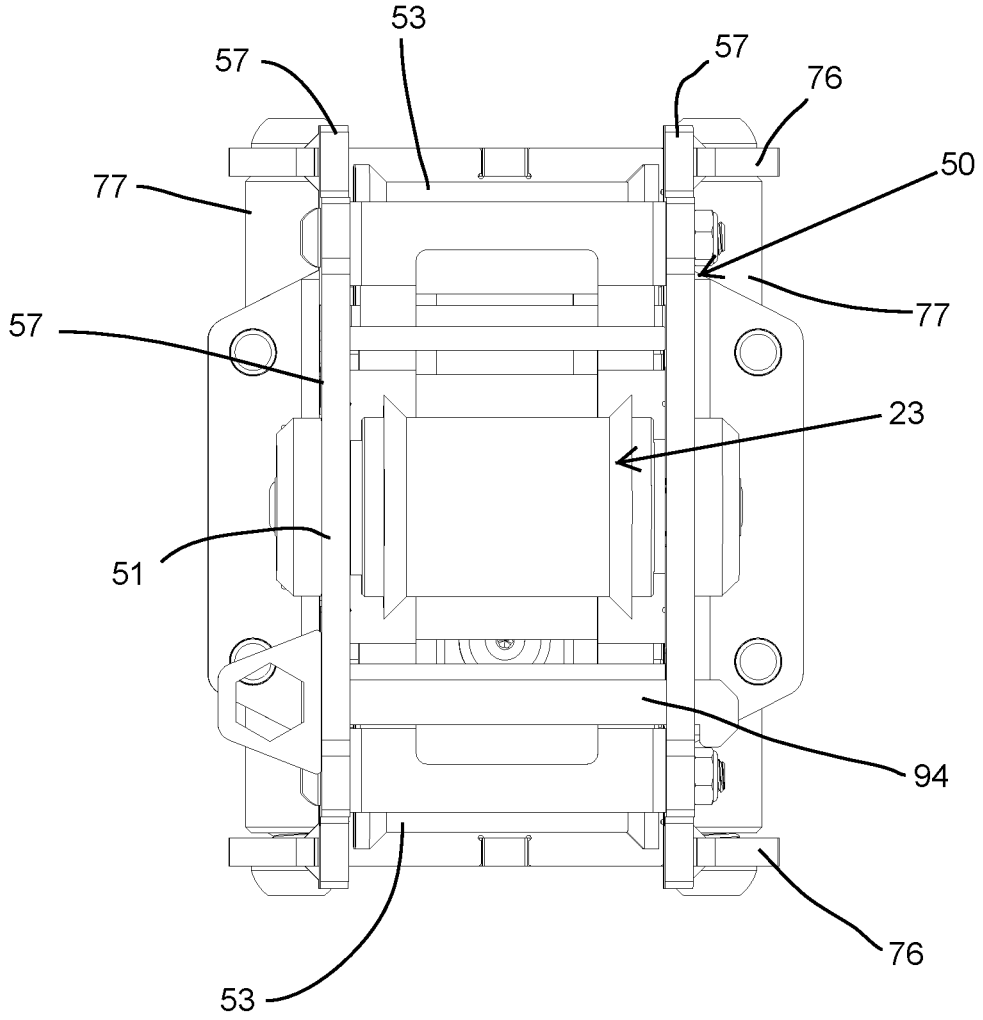
FIG. 3 is a front view of the carriage assembly of FIG. 1.
Figure 4:
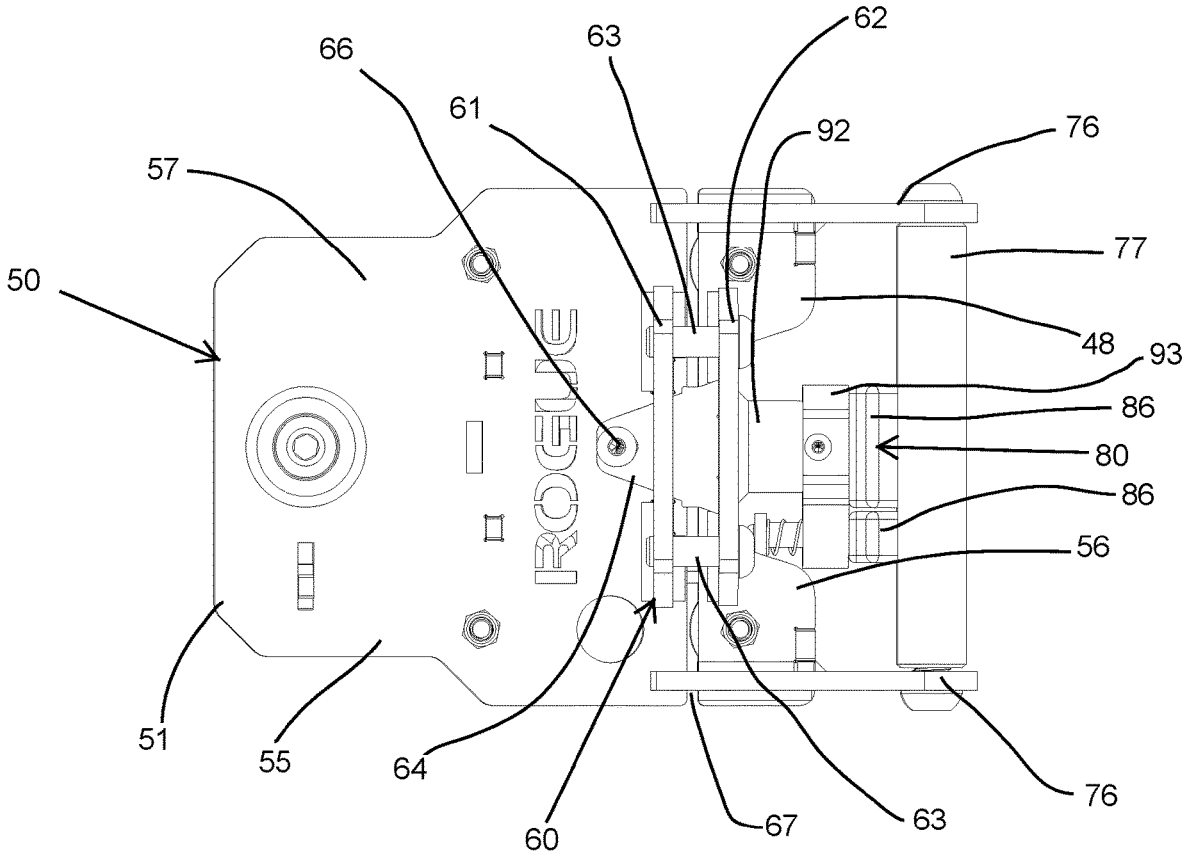
FIG. 4 is a side view of the carriage assembly of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Figure 11:
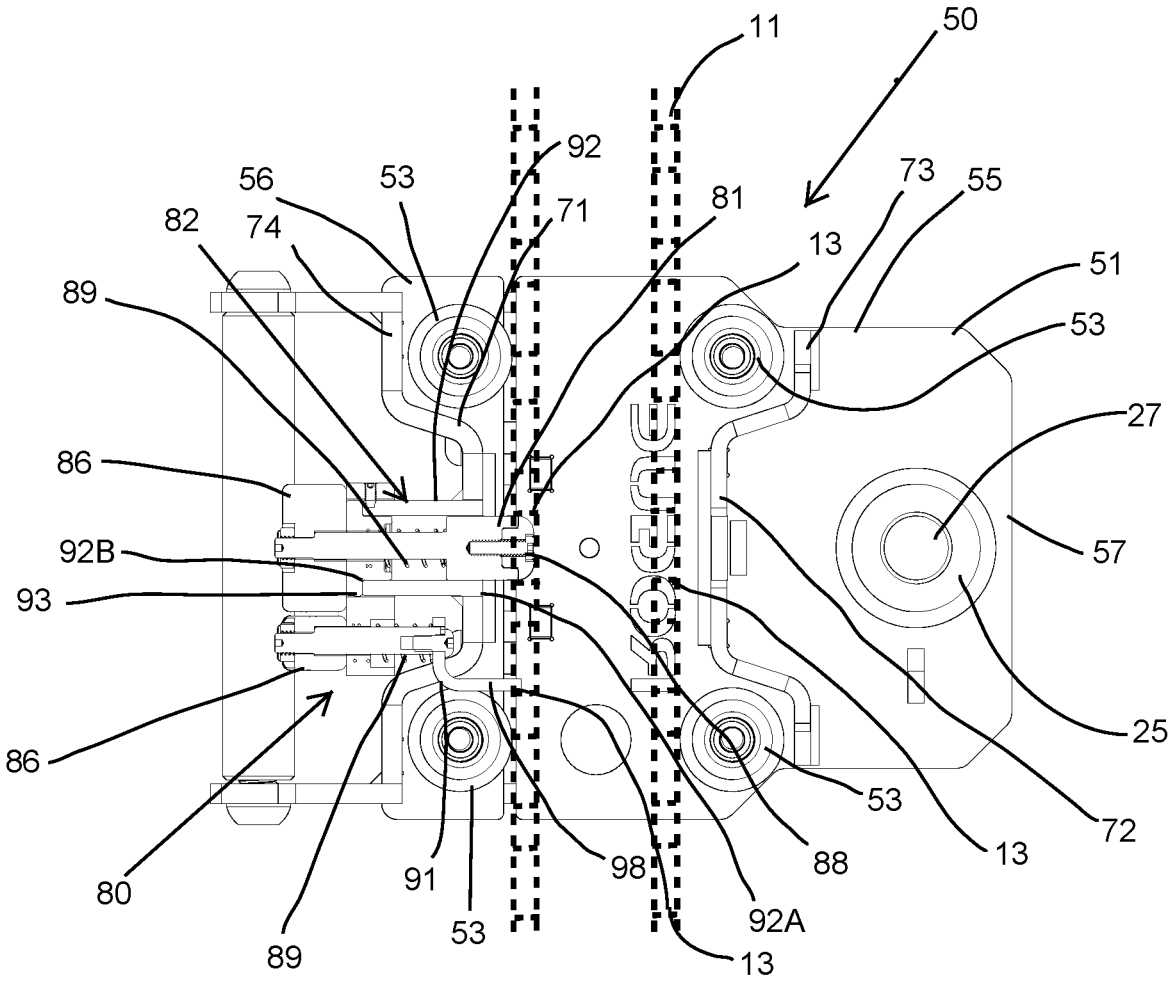
FIG. 11 is a cross-section view taken along lines 11-11 of FIG. 10.
Figure 12:
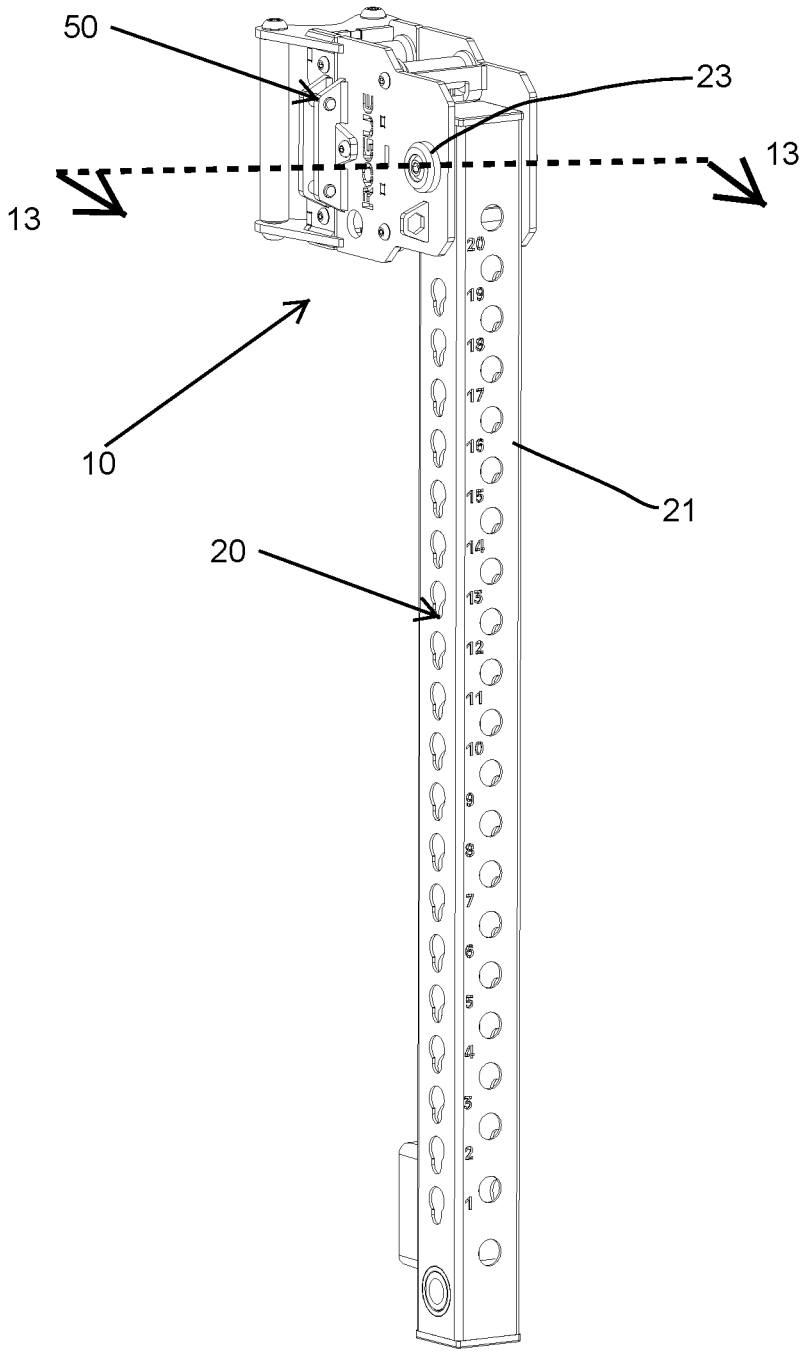
FIG. 12 is a perspective view of one embodiment of a weightlifting assembly including the carriage assembly of FIG. 1 with an implement connected thereto, according to aspects of the present disclosure.
Figure 13:
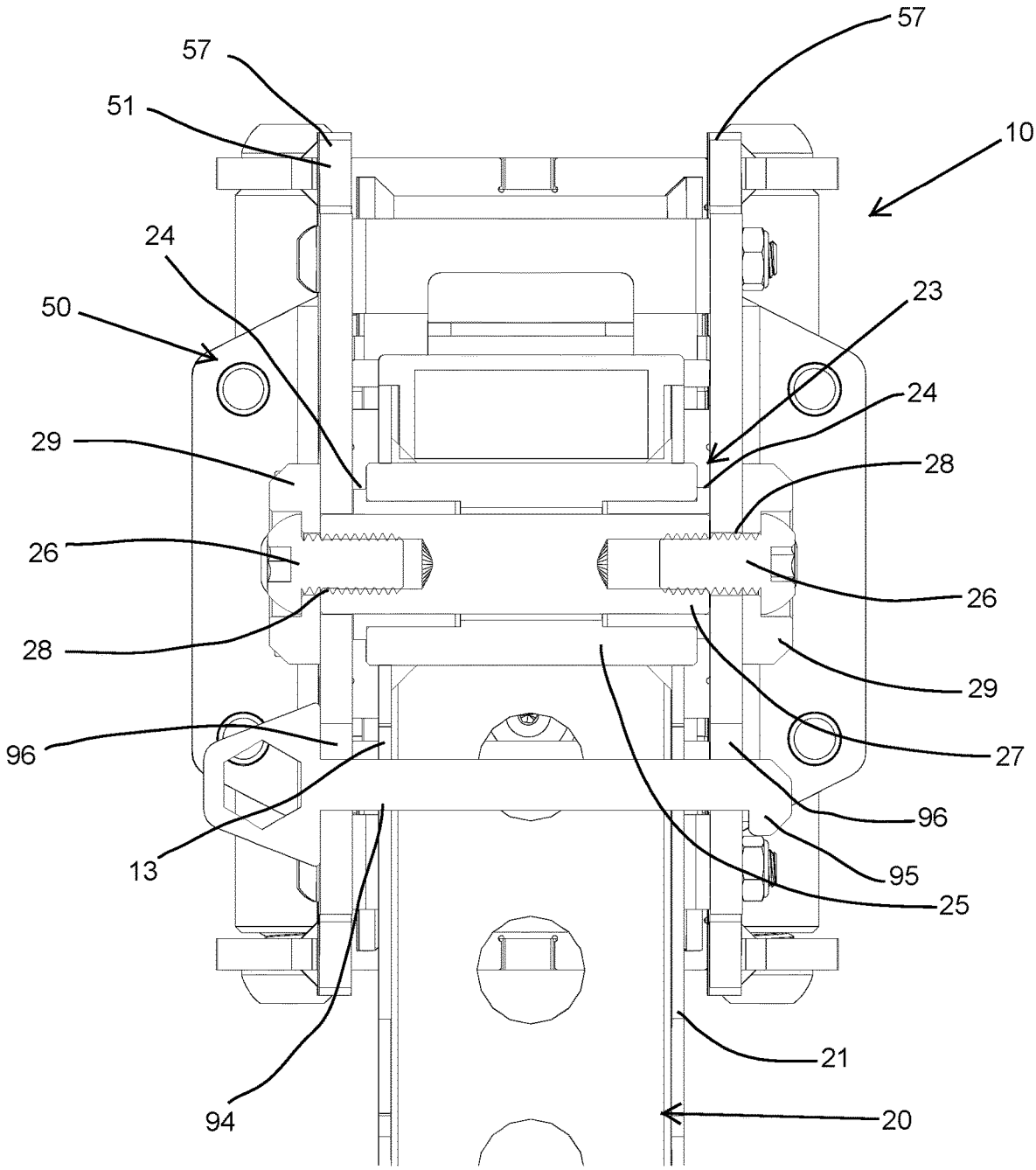
FIG. 13 is a cross-section view taken along lines 13-13 of FIG. 12.
Figure 14:
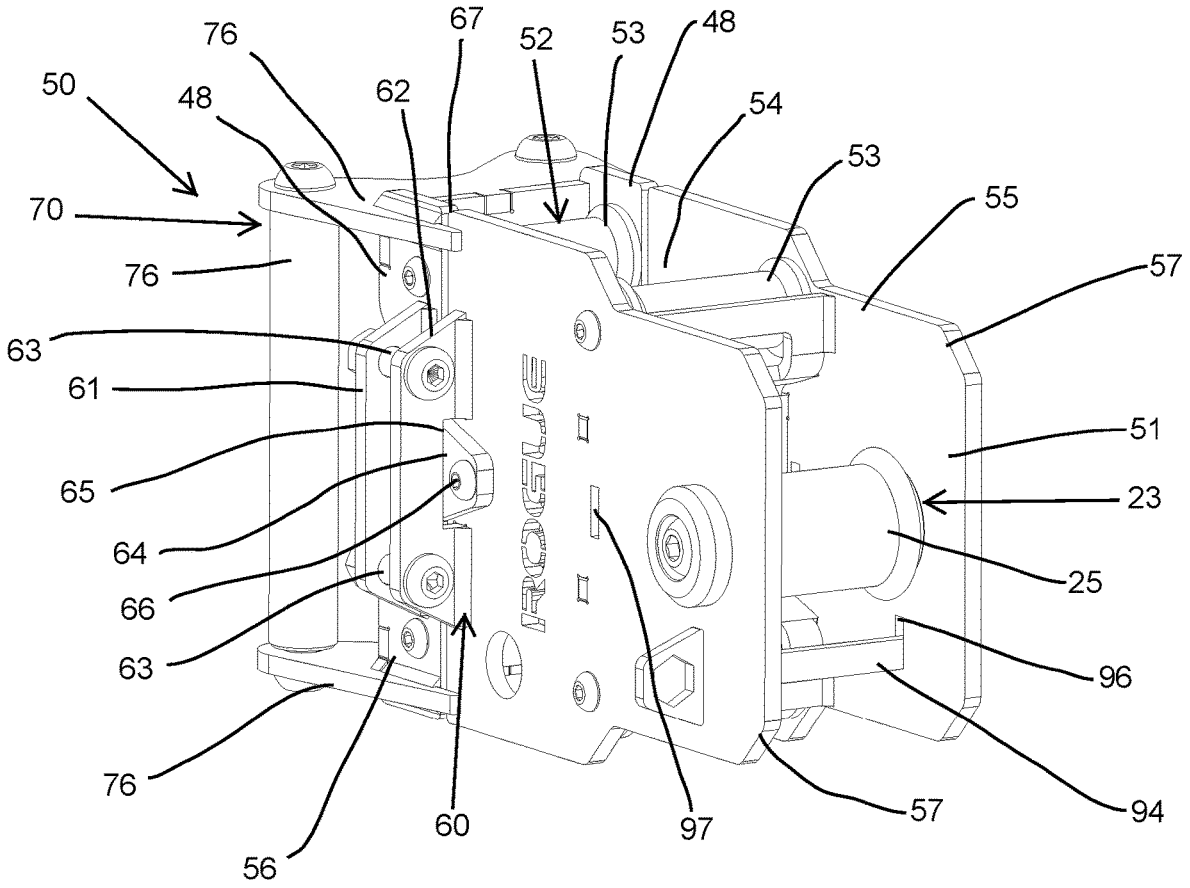
FIG. 14 is a top, front perspective view of another embodiment of a carriage assembly according to aspects of the present disclosure.
Figure 15:
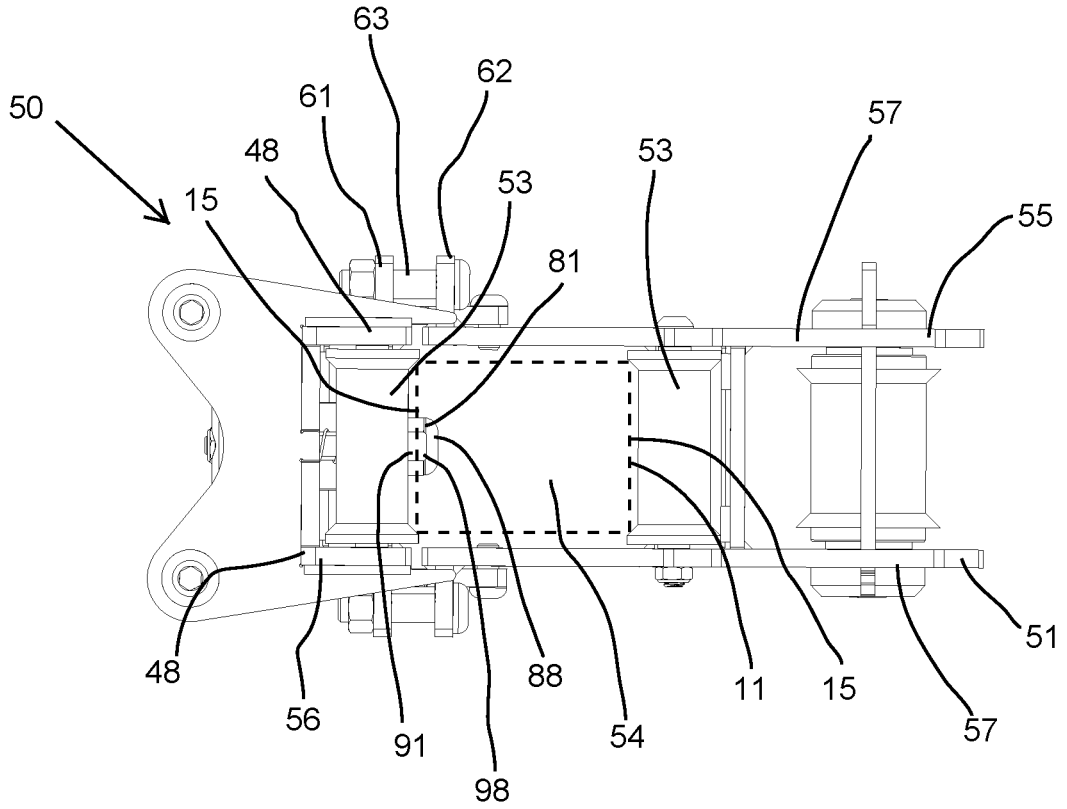
FIG. 15 is a bottom view of the carriage assembly of FIG. 14.
Figure 16:
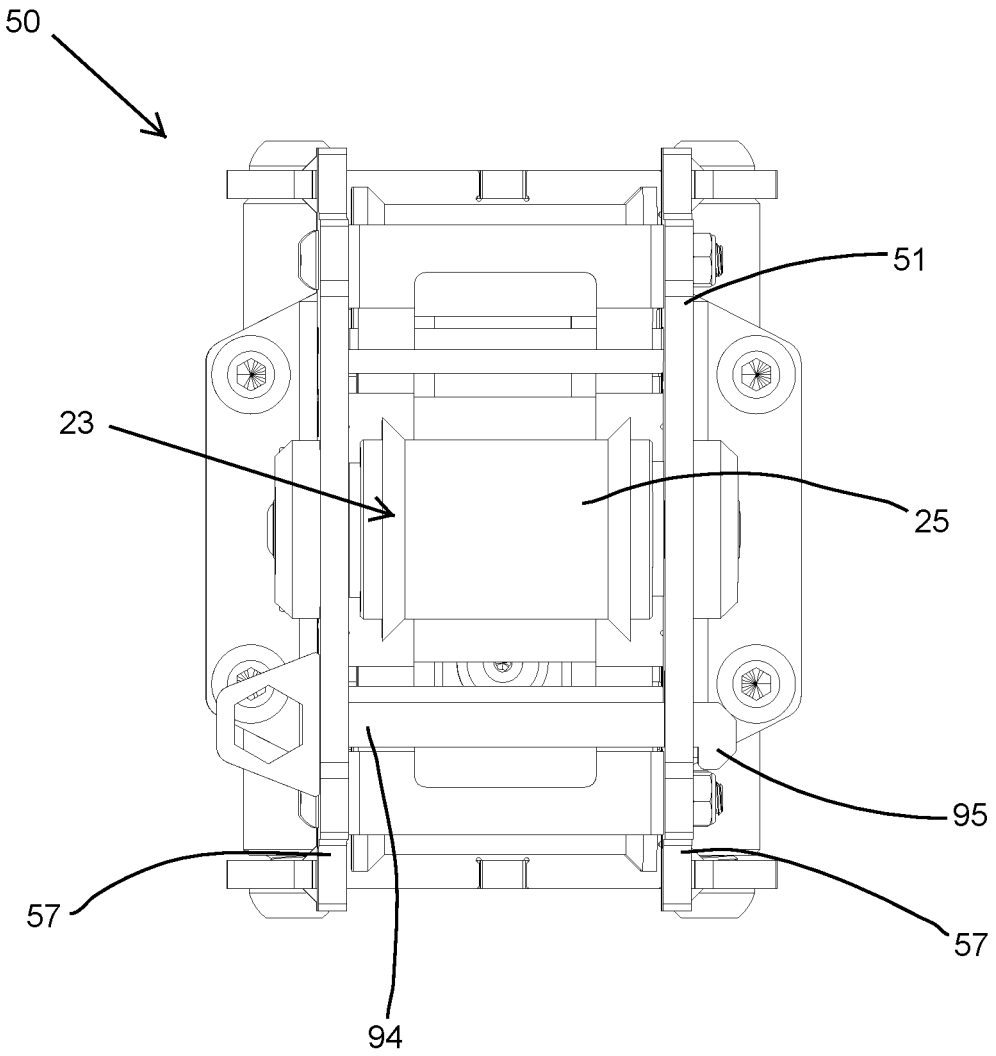
FIG. 16 is a front view of the carriage assembly of FIG. 14.
Figure 17:
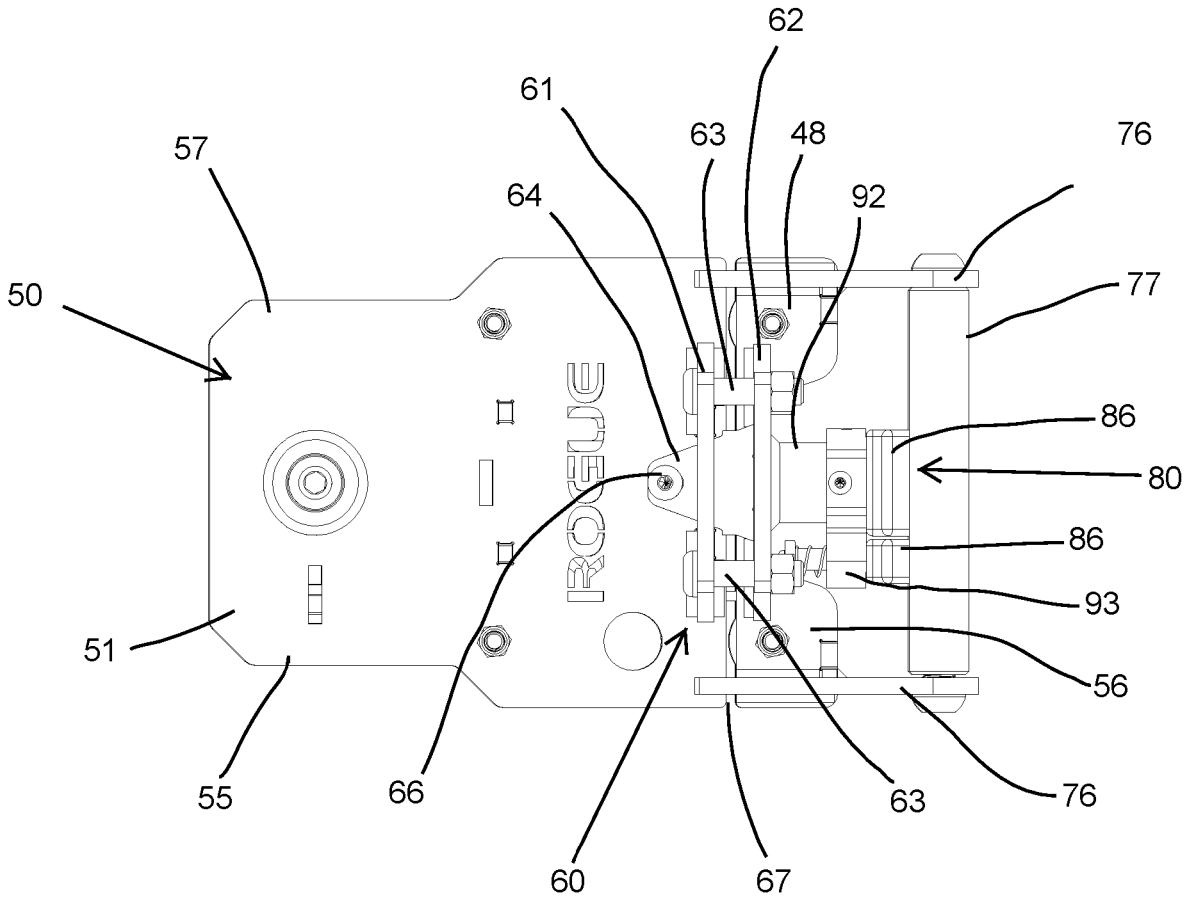
FIG. 17 is a side view of the carriage assembly of FIG. 14.
Figure 18:
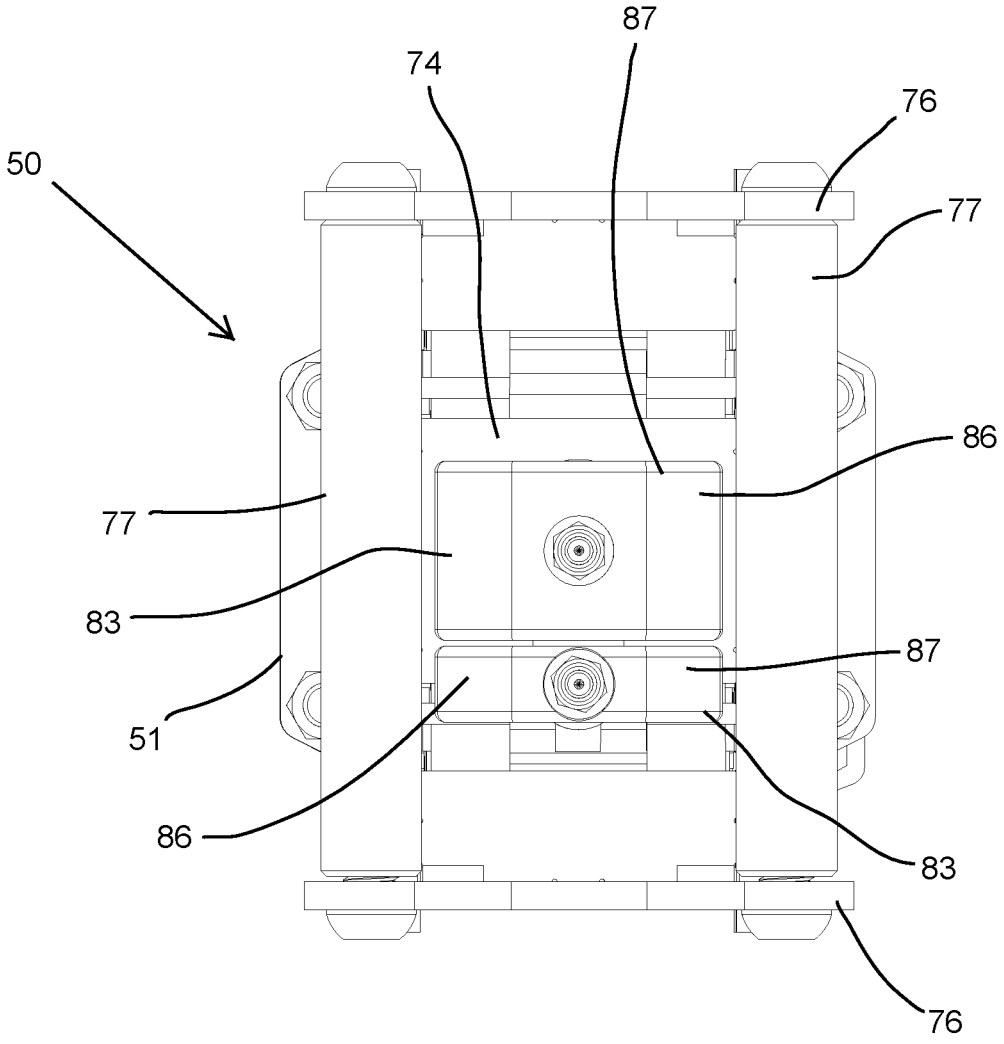
FIG. 18 is a rear view of the carriage assembly of FIG. 14.
Figure 19:
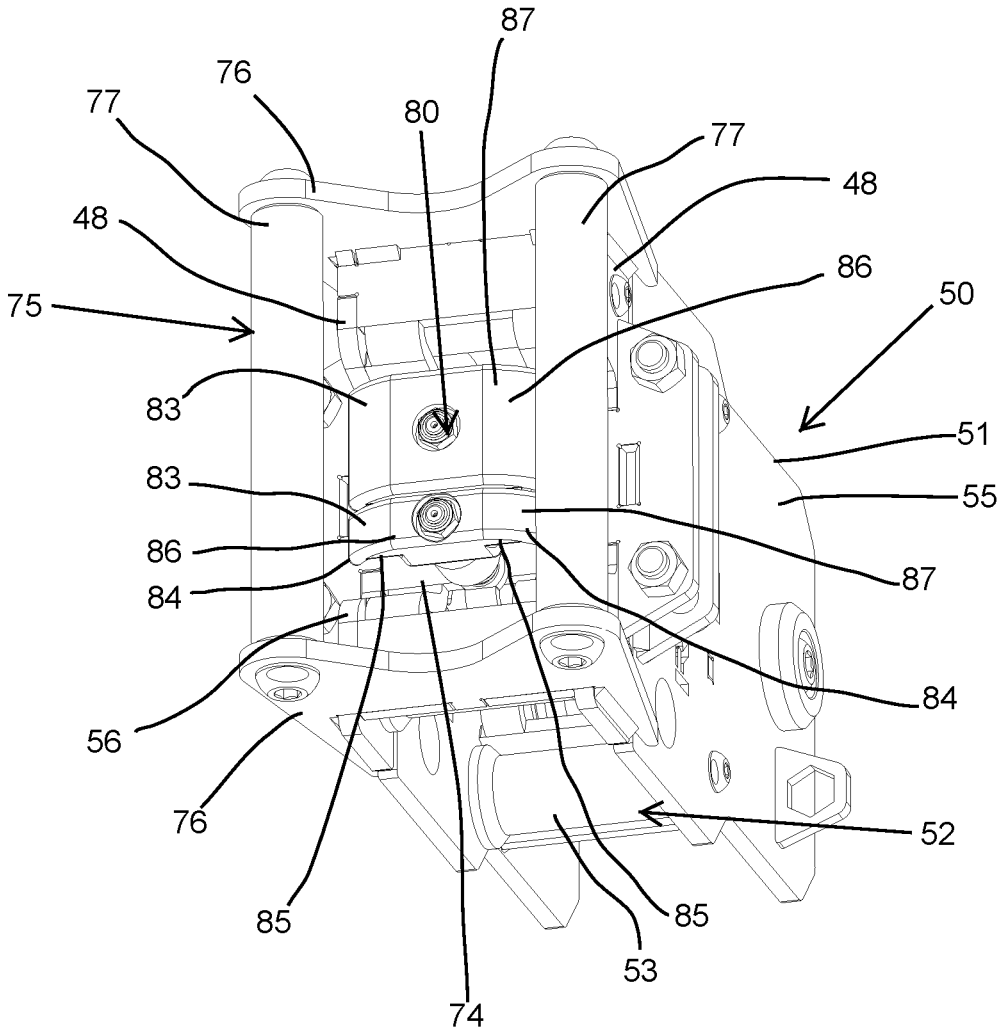
FIG. 19 is a bottom, rear perspective view of the carriage assembly of FIG. 14.
Figure 20:
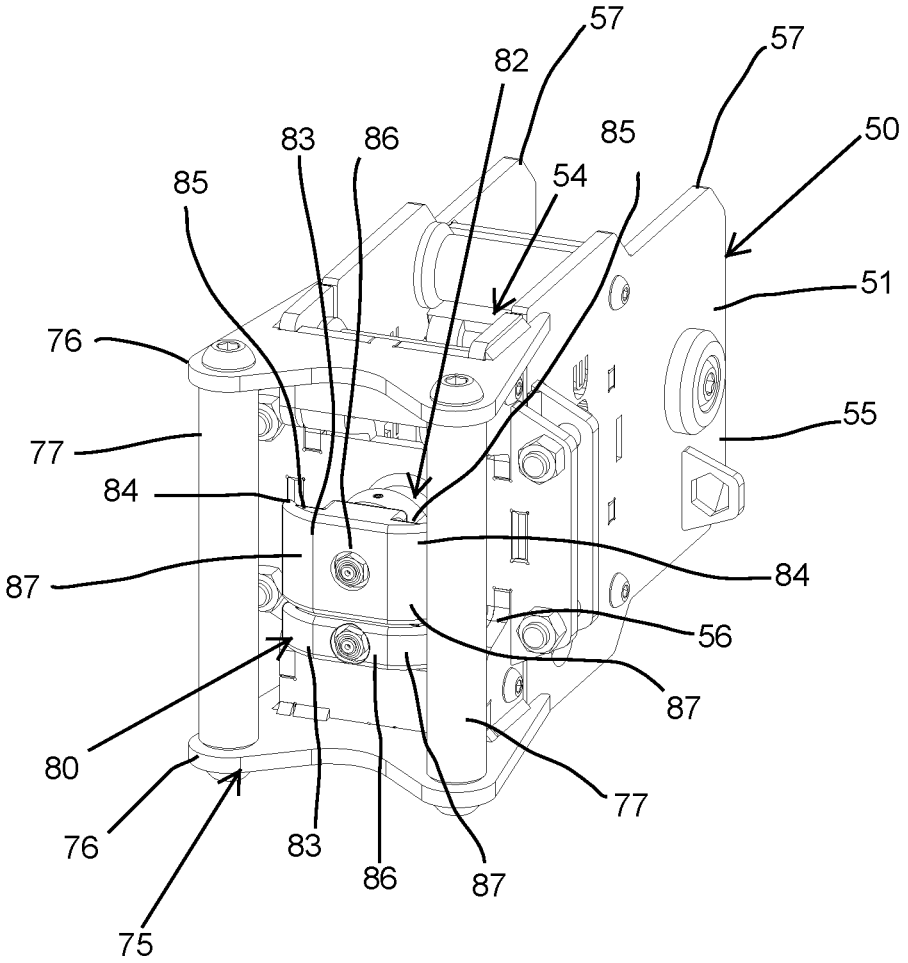
FIG. 20 is a top, rear perspective view of the carriage assembly of FIG. 14.
Figure 21:
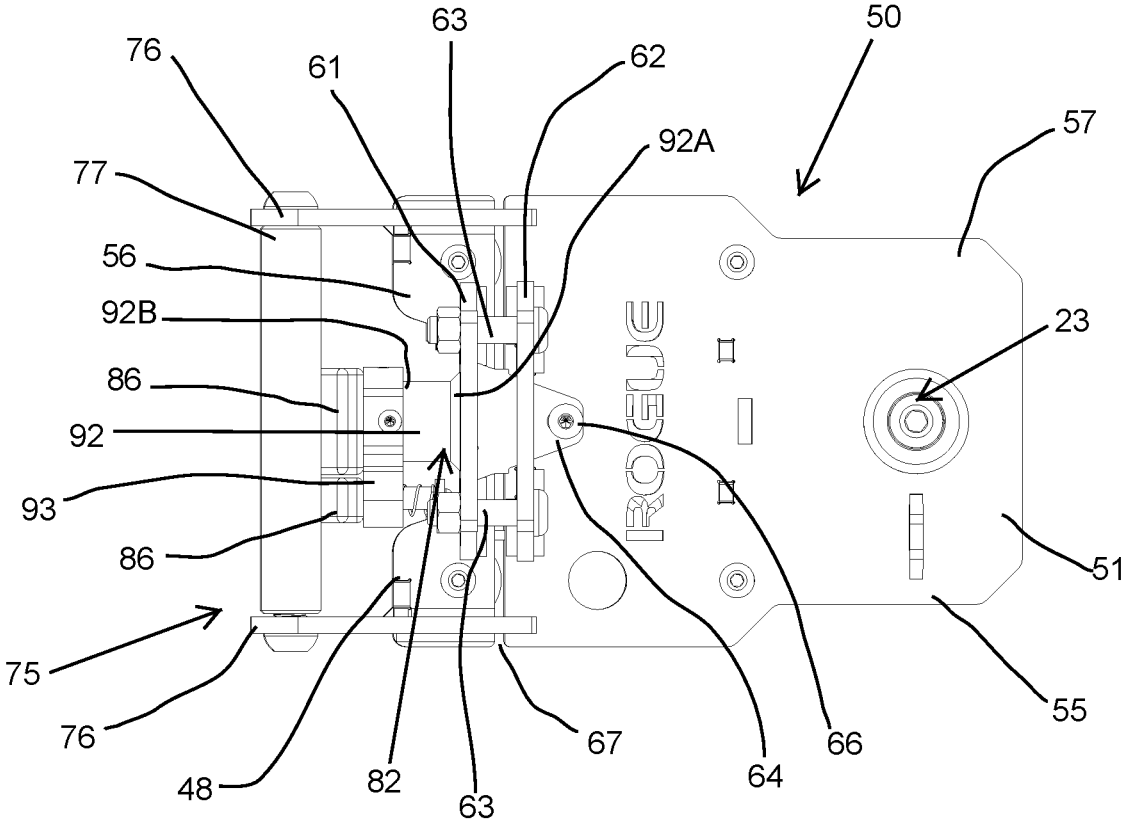
FIG. 21 is a side view of the carriage assembly of FIG. 14.
Figure 22:
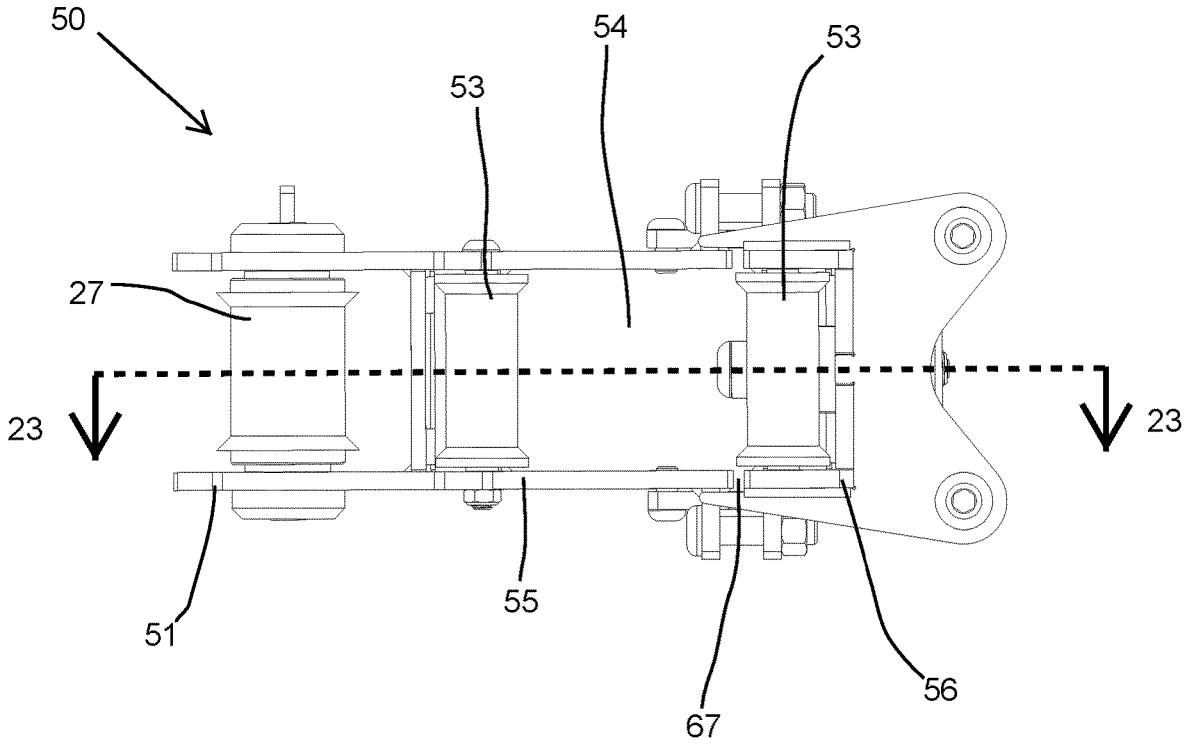
FIG. 22 is a top view of the carriage assembly of FIG. 14.
Figure 23:
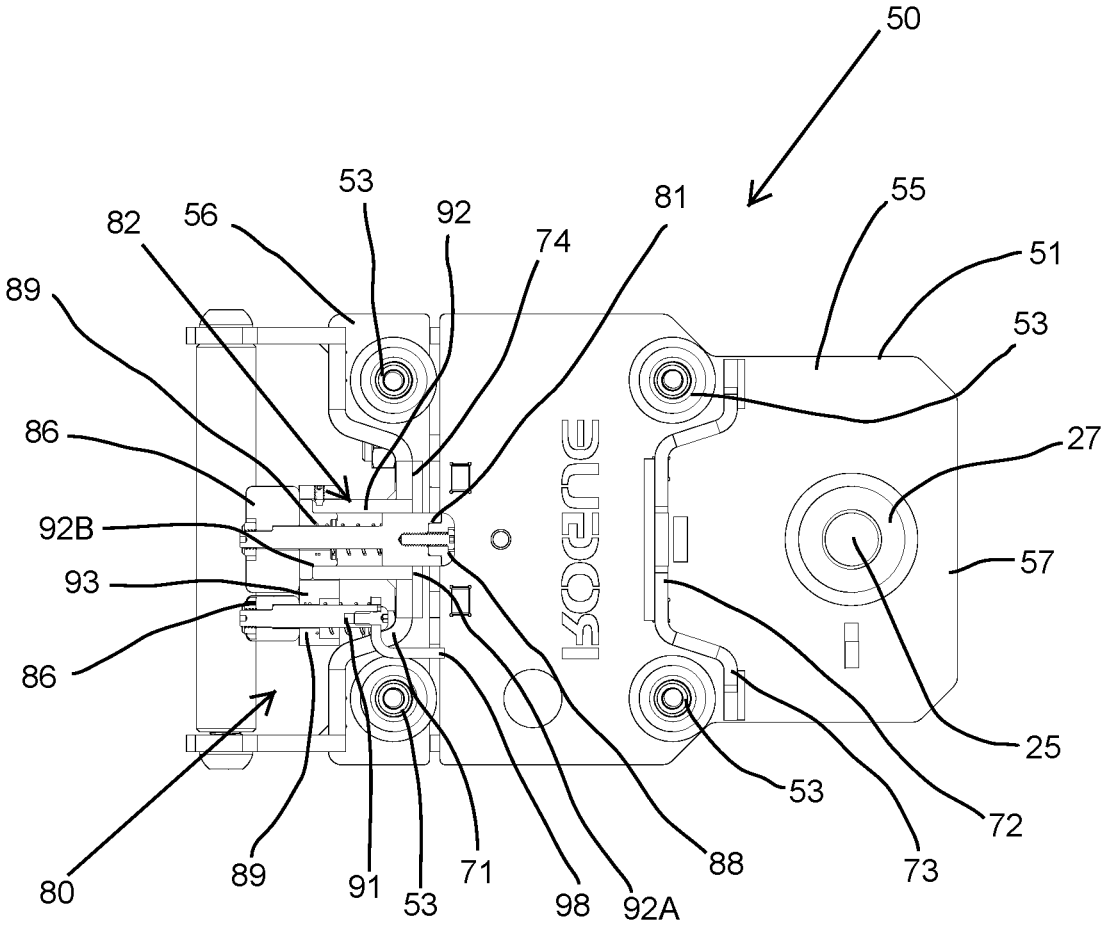
FIG. 23 is a cross-section view taken along lines 23-23 of FIG. 22.

FIGS. 1-11 illustrate a first embodiment of a carriage assembly 50 for connection to a frame member of a weight rack (not shown), such as the vertical member, e.g., as shown in U.S. patent application Ser. No. 16/294,664, filed Mar. 6, 2019, which is incorporated by reference herein in its entirety. FIGS. 12-13 illustrate a weightlifting assembly 10 that includes the carriage assembly 50 of FIGS. 1-11 and an implement 20 connected to the carriage assembly 50. The carriage assembly 50 is configured to be adjustably mounted on a frame member (not shown) to permit sliding of carriage assembly 50 axially along the frame member 11 and fixing of the carriage assembly 50 at a plurality of different axial positions, e.g., vertical positions along the frame member. The implement 20 may be an articulating implement 20 configured for articulating movement in a weightlifting exercise in one embodiment, and may include structures to enable, assist, or complement such movement.

The carriage assembly 50 in the embodiment of FIGS. 1-11 includes a carriage body or carriage 51 that is moveably mounted on a frame member of a weight rack by one or more engaging structures 52. In one embodiment, the engaging structure(s) 52 engage opposite sides or outer surfaces 15 of the frame member 11. The engaging structure(s) 52 in FIGS. 1-11 include rollers 53 that are positioned to engage front and rear outer surfaces or sides 15 of the frame member and define a passage 54 through the carriage 51, such that the frame member extends through the passage 54 in the carriage 51. It is understood that in some configurations, the rollers 53 may only engage the sides 15 of the frame member 11 at or proximate the corners. In this configuration, the frame member is surrounded on all sides by the carriage assembly 50 and is engaged on at least two sides (e.g., front and rear sides) by the carriage assembly 50. In another embodiment, the rollers 53 may be positioned on the left and right sides 15 of the frame member and may engage the left and right sides of the frame member. The carriage assembly 50 in FIGS. 1-11 has four total rollers 53, with two rollers 53 (upper and lower) on each side of the passage 54, i.e., two rollers 53 more proximate to a front of the carriage assembly 50 and two rollers 53 more proximate to a rear of the carriage assembly 50. Each of the rollers 53 has an axle that defines an axis of rotation of the roller 53, and all of the rollers 53 in this embodiment rotate freely on parallel axes. The carriage 51 includes a first or front portion 55 and a second or rear portion 56 that are adjustably connected together, as described further herein. While the carriage 51 in FIGS. 1-11 includes front and rear portions 55, 56 as discussed herein, the carriage 51 may include first and second portions that are laterally spaced from each other in another embodiment. The front portion 55 includes two side plates 57 that are parallel and spaced from each other, and one pair of the rollers 53 is connected to the two plates 57 and extend between the two plates 57. The rear portion 56 includes two side plates 48 that are parallel and spaced from each other, and may further include a rear plate or transverse plate 74 that is connected to both plates 48 and extends laterally between the plates 48 transverse or perpendicular to both plates 48. The other pair of the rollers 53 is connected to the two plates 48 of the rear portion 56 and extend between the two plates 48. The side plates 48 and the rear plate 74 in FIGS. 1-11 define a recess or indent 71 extending forwardly toward the passage 54 to accommodate portions of a locking structure 80 described in greater detail herein. The carriage 51 may further include an additional front transverse plate 73 that is connected to both plates 57 of the front portion 55 and extends laterally between the plates 57 transverse or perpendicular to both plates 57. The front transverse plate 73 may likewise have a recess or indent 72 that extends rearwardly toward the passage 54 in this embodiment.

The plates 57 define the lateral sides of the passage 54 in this embodiment, with the rollers 53 defining the front and rear sides of the passage 54. The plates 48 may further define a portion of the lateral sides of the passage 54 in one embodiment. The rollers 53 provide the points of moveable engagement between the carriage assembly 50 and the frame member in the embodiment of FIGS. 1-11, and may provide the sole points of constant engagement between the carriage assembly 50 and the frame member in one embodiment. The rollers 53 may be made from a hard plastic (e.g., UHMW) or other polymer material in one embodiment, but may be made from other materials (e.g., aluminum or other metals) in another embodiment.

The rollers 53 in the embodiment of FIGS. 1-11 and the engagement of the rollers 53 with the frame member 11 are described and illustrated in greater detail in U.S. patent application Ser. No. 16/294,664, filed Mar. 6, 2019, which is incorporated by reference herein. In another embodiment, the rollers 53 may engage the frame member 11 in another manner. In a further embodiment, the carriage assembly 50 may include engaging structures 52 that engage the frame member 11 in a different manner, and the frame member 11 may include complementary structures for such engagement. For example, the frame member 11 may include rails, flanges, grooves, lips, or other structures that are engaged by engaging structures 52 of the carriage assembly 50, such as rollers, wheels, clamps, etc. The carriage assembly 50 in the embodiment of FIGS. 1-11 is configured to move by translation up and down along the frame member, and the rollers 53 roll against the outer surfaces of the frame member during this movement. The frame member may have stops (not shown) near the bottom and/or the top of the frame member that prevent further movement of the carriage assembly 50.

The carriage assembly 50 is configured such that the spacing between the front portion 55 and the rear portion 56 is adjustable, and the front and rear portions 55, 56 may be two separable, unitary structures in one configuration. As shown in FIGS. 1-11, the carriage assembly 50 includes an adjustment structure 60 connected to the front and rear portions 55 to enable such adjustment. The adjustment structure 60 in FIGS. 1-11 includes adjustment plates 61, 62 extending outward from the outer surfaces of both of the side plates 57, 48 on the front and rear portions 55, 56, respectively, with adjustment members 63 engaging the adjustment plates 61, 62 to adjust the spacing between them. The adjustment plates 61, 62 may be in the form of wings or flanges connected to the outer surfaces of the side plates 57, 48, respectively, by welding and/or other joining technique. The adjustment members 63 in FIGS. 1-11 are in the form of bolts or other threaded members that threadably engage holes in the adjustment plates 61, 62, such that rotation of the adjustment members 63 increases or decreases the spacing between the adjustment plates 61, 62, thereby also increasing or decreasing the spacing between the front and rear portions 55, 56. The carriage assembly 50 also includes a fixing structure for fixing the front and rear portions 55, 56 in position relative to each other once the desired spacing has been reached via the adjustment structure 60. The fixing structure in FIGS. 1-11 includes two arms 64 that are fixedly connected to the rear portion 56 on opposite sides of the carriage 51, e.g., by welding to the rear adjustment plates 62, which are configured to fixedly engage the front portion 55. The arms 64 in FIGS. 1-11 each extend across the gap 67 between the front and rear portions 55, 56 and through a passage 65 in one of the front adjustment plates 61, and fasteners 66 can then fixedly and releasably connect the arms 64 to the side plates 57 of the front portion 55, thereby fixing the front and rear portions 55, 56 in desired positions. The connection of the arms 64 to the front portion 56 is releasable, such that releasing the releasable connection permits adjusting the space between the front portion 55 and the rear portion 56 by the adjustment structure 60. Each arm 64 has an elongated slot (not shown) to receive the fastener 66, which allows for a range of motion for different spacings. By increasing or decreasing the spacing between the front and rear portions 55, 56, the spacing between the front and rear pairs of rollers 53 is increased or decreased to create the desired level of engagement with the frame member within the passage 54. In another embodiment, a different adjustment structure 60 may be used. The positions of the arms 64 may be reversed in another embodiment, such that the arms 64 are fixedly connected to the front portion 55 and releasably connected to the rear portion 56. The arms 64 may therefore be considered to be fixedly connected to one of the front and rear portions 55, 56 and extending across the space between the front portion and the rear portion 55, 56. The arms 64 are also configured for releasable connection to the other of the front and rear portions 55, 56 to fix the front and rear portions 55, 56 in a desired position with respect to each other.

The carriage assembly 50 in FIGS. 1-11 includes a handle assembly 75 connected to the carriage 51 to provide a component (e.g., one or more handles) for gripping by the user to assist in movement of the carriage assembly 50 along the frame member 11 and/or carrying the carriage assembly 50 when not mounted on the frame member 11. The handle assembly 75 in one embodiment includes one or more handle mounts 76 that are connected to the carriage 51 and handles 77 connected to the handle mount(s) 76. The handle mounts 76 in FIGS. 1-11 are connected only to the rear portion 56 of the carriage 51, e.g., by fixing to the side plates 48. The handle assembly 75 is shown and described in further detail in U.S. patent application Ser. No. 16/294,664, filed Mar. 6, 2019, which is incorporated by reference herein.

The carriage assembly 50 in one embodiment also includes a moveable and/or releasable locking structure 80 configured for engaging the frame member 11 selectively locking the carriage assembly 50 in position with respect to the frame member 11. The locking structure 80 may include at least one retractable pin 81, 91 configured to releasably engage the frame member 11 within the passage. In the embodiment of FIGS. 1-11, the carriage assembly 50 includes two axially moveable pins (a first or main pin 81 and a second or auxiliary pin 91) that are configured to extend through a hole or holes 13 in the frame member 11 to fix the carriage assembly 50 in position on the frame member 11. In one embodiment, the main pin 81 is configured to extend through a different hole 13 in the same side of the frame member 11 than the auxiliary pin 91, located above the hole 13 receiving the auxiliary pin 91. This is shown in FIG. 11, which schematically illustrates the frame member 11 in broken lines. The pins 81, 91 in FIGS. 1-11 are both spring loaded pins that extend through the rear plate 74 of the carriage assembly 50. The pins 81, 91 in this embodiment are axially moveable (i.e., by axial translation) between a locked position, where the pin 81, 91 extends into the passage 54 to engage the frame member 11, such as by being received in a hole 13 of the frame member 11, and a free or unlocked position, where the pin 81 is retracted and does not engage the frame member 11. The main pin 81 has a main pin end 88 received in one of the holes 13 in the locked position, and the auxiliary pin 91 has an auxiliary pin end 98 received in another hole 13 located below the hole 13 receiving the main pin end 88, as shown in FIG. 11. In one embodiment, the main and auxiliary pin ends 88, 98 may be received in vertically adjacent or sequential holes 13 along the vertical length of the frame member 11, and in another embodiment, the main and auxiliary pin ends 88, 98 may be received in vertically spaced holes 13 that are not adjacent or sequential along the vertical length of the frame member 11. The pins 81, 91 are illustrated in the locked positions in FIGS. 1-11, with the understanding that the pins 81, 91 would be retracted rearwardly in the free positions, e.g., to the left in FIG. 11. The locked position and the free position for each pin 81, 91 may therefore be considered an extended position and a retracted position, respectively, in the embodiment of FIGS. 1-11. In the locked positions, the engagement between the pins 81, 91 and the frame member 11 resists movement of the carriage assembly 50 along the length of the frame member 11 (e.g., vertically), and in the free positions, the carriage assembly 50 is free to move along the length of the frame member 11. It is understood that in the embodiment of FIGS. 1-11, both the main and auxiliary pins 81, 91 must be retracted to permit the carriage assembly 50 to move along the frame member 11.

In one embodiment, the main pin 81 and/or the auxiliary pin may be biased toward the locked positions. The locking structure 80 in FIGS. 1-11 includes a collar assembly 82 connected to the rear plate 74 and housing and/or engaging springs 89 or other biasing member(s) or mechanism(s) (see FIG. 11) configured to engage the pins 81, 91 and bias the pins 81, 91 toward the locked positions, i.e., toward the front of the carriage assembly 50 in the embodiment of FIGS. 1-11. The collar assembly 82 in FIGS. 1-11 includes a first collar piece 92 connected to the transverse plate 74 at its proximal end 92A and having a distal end 92B opposite the proximal end 92A and a second collar piece 93 connected to the distal end 92B of the first collar piece 92 (e.g., by a set screw). The first collar piece 92 receives the main pin 81 therethrough, and the second collar piece 93 has openings to receive both the main and auxiliary pins 81, 91 therethrough.

The second collar piece 93 also abuts two springs 89 that are each engaged with one of the pins 81, 91 to bias the pins 81, 91 to the locked positions. In this configuration, the carriage assembly 50 is locked in position with respect to the frame member 11 unless the locking structure 80 is manipulated to be released, e.g., by pulling both of the pins 81, 91 to the free positions. In this configuration, the auxiliary pin 91 acts as a safety mechanism to prevent unintentional movement of the carriage assembly 50 in the event that the main pin 81 is inadvertently not properly engaged with the frame member 11. The auxiliary pin 91 has a smaller profile than the main pin 81 in this configuration. The locking structure 80 in one embodiment may also include a removable pin (not shown) that extends through both of the plates 57 transversely and extends through the holes 13 in the frame member 11 transverse to the pins 81, 91 to further secure the carriage assembly 50 in position, such as shown and described in in U.S. patent application Ser. No. 16/294,664, filed Mar. 6, 2019, which is incorporated by reference herein.

The carriage assembly 50 in FIGS. 1-11 has the pins 81, 91 located between the handles 77 of the handle assembly 75 and located at the midpoint between the handles 77. Each pin 81, 91 may also include one or more actuation structures, which may be in the form of an engagement member configured to be manipulated by the user. The engagement members of both pins 81, 91 in FIGS. 1-11 include grips 83 configured to facilitate manipulation of the pins 81, 91 together while simultaneously gripping the handles 77. Each pin 81, 91 in the embodiment of FIGS. 1-11 has an engagement member including an end piece 86 having two grips 83 extending outward from left and right lateral sides at the rearward-most end of the pin 81, 91. The grips 83 in this embodiment are in the form of vertical flanges that extend laterally outward and curve forwardly at the distal ends 84 to form recesses 85 on the front sides of the grips 83. In this configuration, the grips 83 are configured to be engaged by the user's fingers, such that the user's fingers engage the distal ends 84 and/or are received in the recesses 85 to pull the respective pin 81, 91 rearwardly to the free position when the user's hands are on the handles 77. Additionally, the grips 83 in FIGS. 1-11 are formed as part of two substantially T-shaped end pieces 86 that are each connected to the rear end of one of the pins 81, 91 and has the grips 83 extending outwardly from both sides, with curved rear surfaces 87 extending to the distal ends 84. This configuration creates an ergonomic and aesthetically pleasing form for the actuation structure of the pin 81, 91. The user is able to grip the handles 77 and actuate the pins 81, 91 to the free positions by pulling on the grips 83 with one or more fingers, and the structure and positioning of the grips 83 permits the user to easily maintain his/her grip on the handles 77 and the grips 83 to lift or lower the carriage assembly 50. The grips 83 and the end pieces 86 on both the main and auxiliary pins 81, 91 in FIGS. 1-11 have the same shapes when viewed from above and are immediately adjacent to one another, which facilitates simultaneous actuation of the pins 81, 91. The end piece 86 of the main pin 81 is above and immediately vertically adjacent to the end piece 86 of the auxiliary pin 91 in the embodiment of FIGS. 1-11. The auxiliary pin 91 may have an offset configuration, such that the auxiliary pin end 98 is spaced further from the main pin end 88 than the engagement members (e.g., end pieces 86) of the main and auxiliary pins 81, 91 are spaced.

Figure 5:
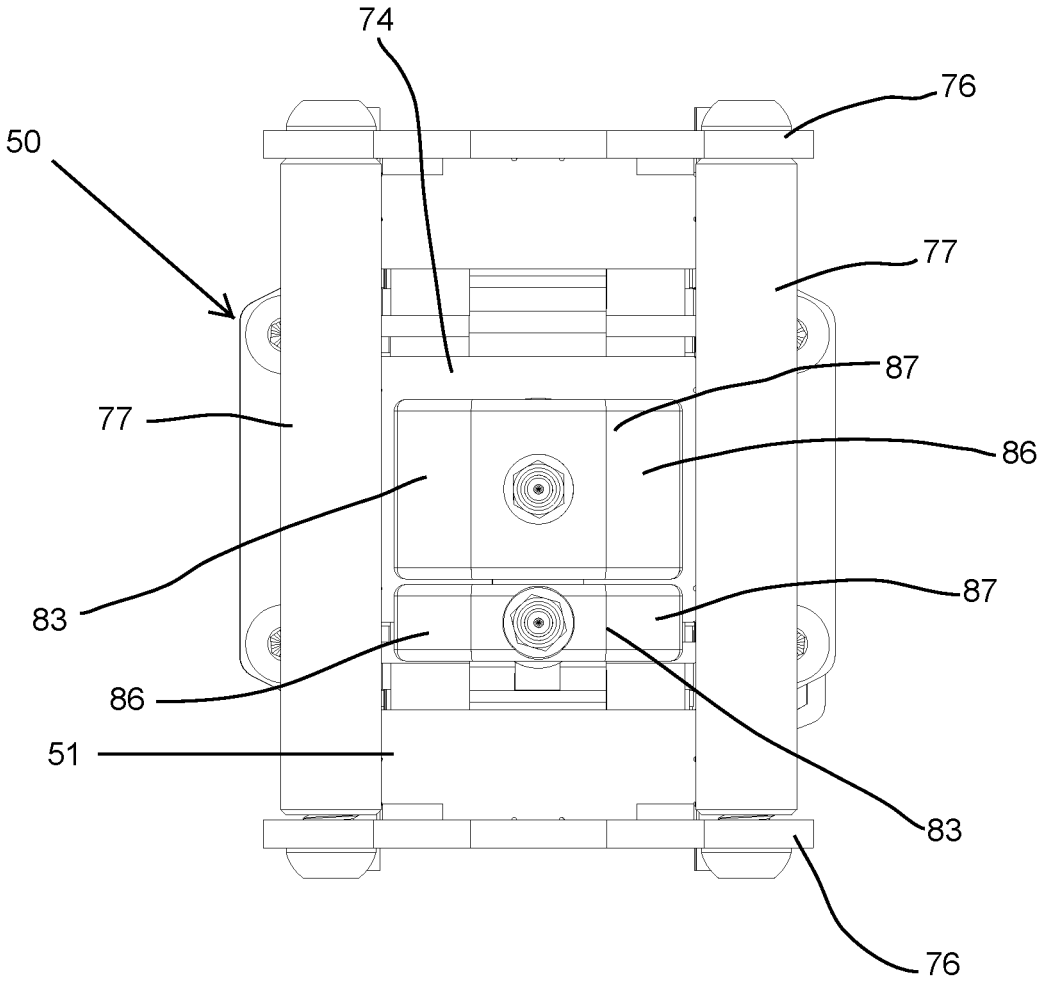
FIG. 5 is a rear view of the carriage assembly of FIG. 1.
Figure 6:
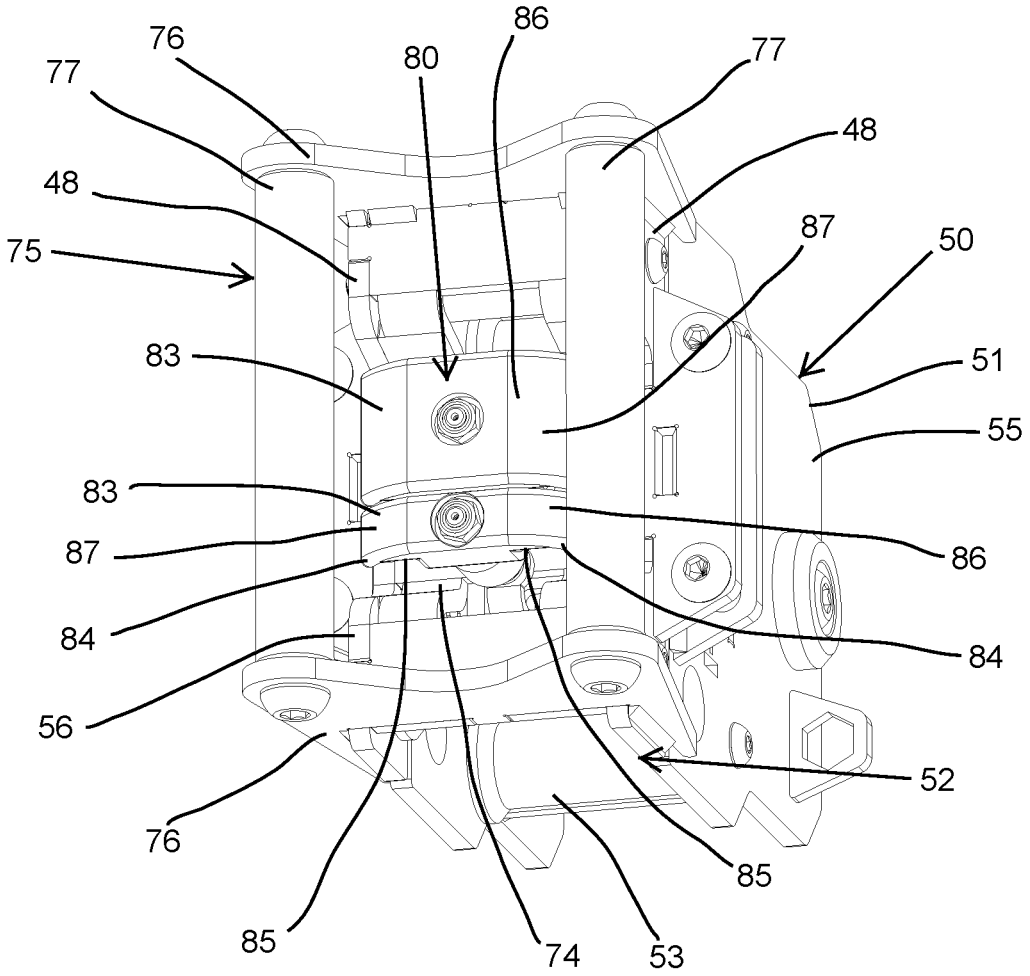
FIG. 6 is a bottom, rear perspective view of the carriage assembly of FIG. 1.
Figure 7:
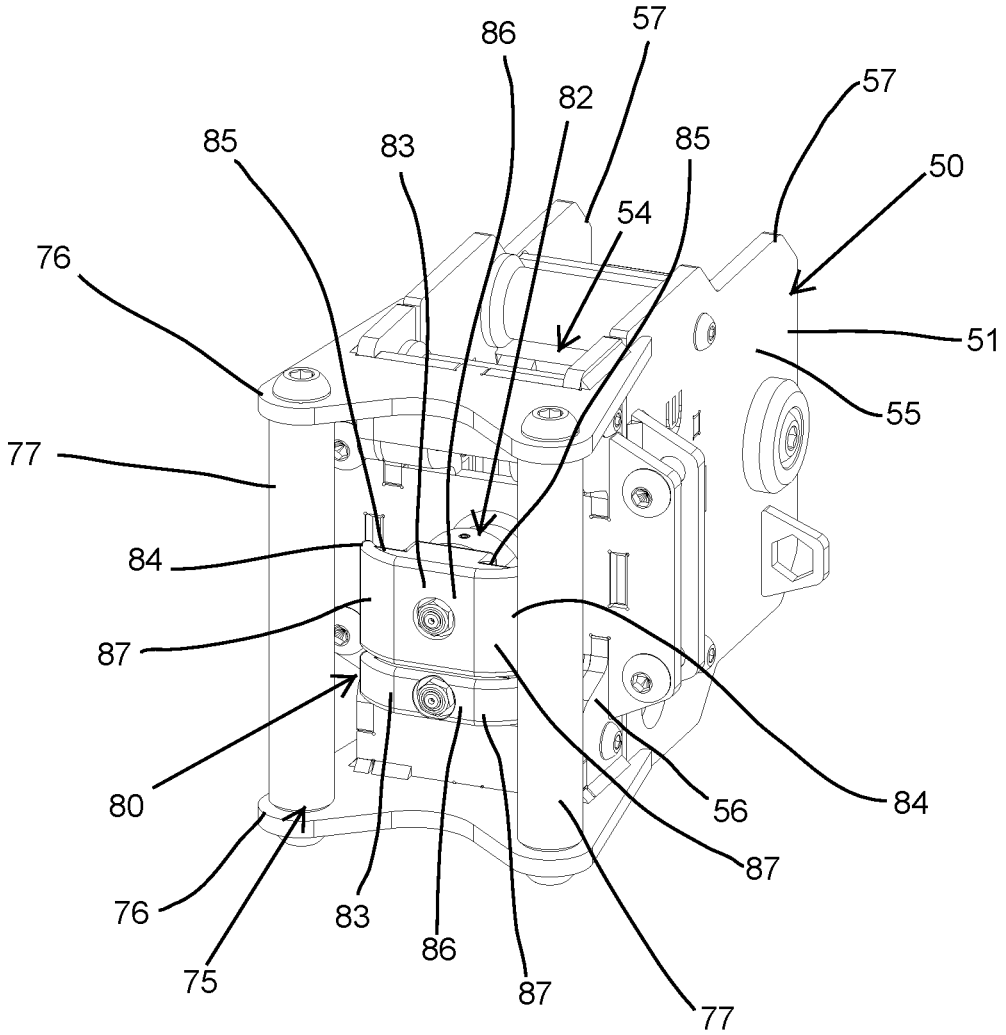
FIG. 7 is a top, rear perspective view of the carriage assembly of FIG. 1.
Figure 8:
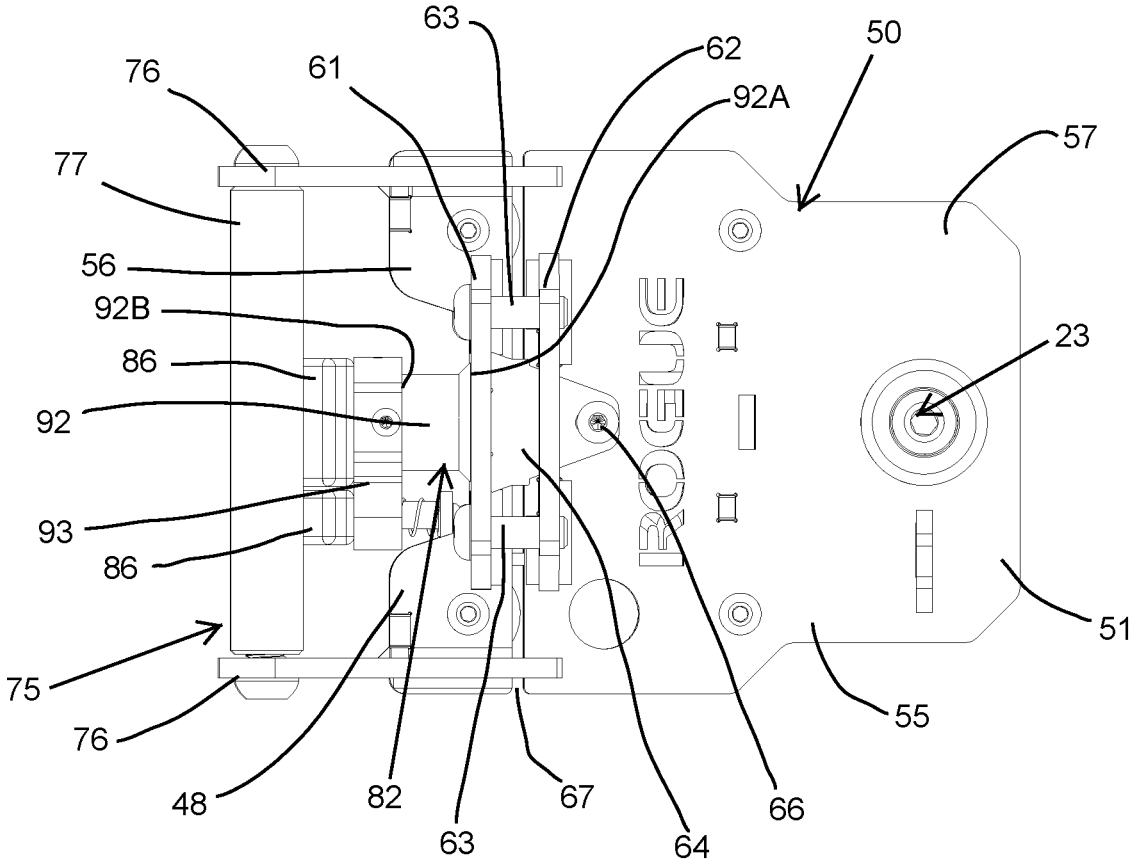
FIG. 8 is a side view of the carriage assembly of FIG. 1.

Movement of the carriage assembly 50 in the embodiment of FIGS. 1-11 can be accomplished by pulling the grips 83 of both pins 81, 91 while gripping the handles 77 to retract the pins 81, 91, then raising or lowering the carriage assembly 50 to the desired position, and then releasing the pins 81, 91, which will be pushed back to the locked position by the springs 89 when the ends of the pins 81, 91 are aligned with one of the holes 13 in the frame member 11. The pins 81, 91 in FIGS. 1-11 are positioned such that the main pin 81 and the auxiliary pin 91 are received in different holes 13 in the frame member 11. As seen in FIG. 5, the length of the pins 81, 91 are sufficient to extend into one of the holes 13 on the frame member 11, but not sufficient to extend completely through the frame member 11. In another embodiment, either or both of the pins 81, 91 may have increased length, with the understanding that this configuration may require greater travel distance for retraction of the pin(s) 81, 91. By allowing the user to retract the pins 81, 91 while gripping the handles 77, this configuration facilitates moving the carriage assembly 50, which may have significant weight, particularly if connected to an implement 20. Additionally, the configuration of the locking structure 80 in this embodiment increases the safety of the carriage assembly 50, because the user will naturally be gripping the handles 77 when retracting the pins 81, 91 and will therefore be less likely to drop the carriage 50, and even if the user releases his/her grip on the handles 77 and the grips 83, the biasing mechanism 89 will cause the pins 81, 91 to automatically engage the frame member 11 to lock the carriage assembly 50 in place again. Safety is further increased by the use of the auxiliary pin 91 that helps avoid inadvertent dropping of the carriage assembly 50.

In other embodiments, the locking structure 80 may have another configuration, including pins having other configurations or other types of mechanical locking structures, which may be configured to engage the holes 13 in the frame member 11 and/or other structures of the frame member 11. For example, either or both of the pins 81, 91 may include a retaining structure to retain the pin(s) 81, 91 in the hole and in connection with the frame member 11, including a detent, a tab, a cotter key, or other structure. As another example, the pin(s) 81, 91 may not be spring-biased, and may be in the form of a sliding pin with a retaining structure to lock the pin(s) 81, 91 in the locked position. In a further embodiment, the locking structure 80 may be configured to engage a frame member 11 without holes, and may include structures such as clamps, brakes, etc.

Figure 9:
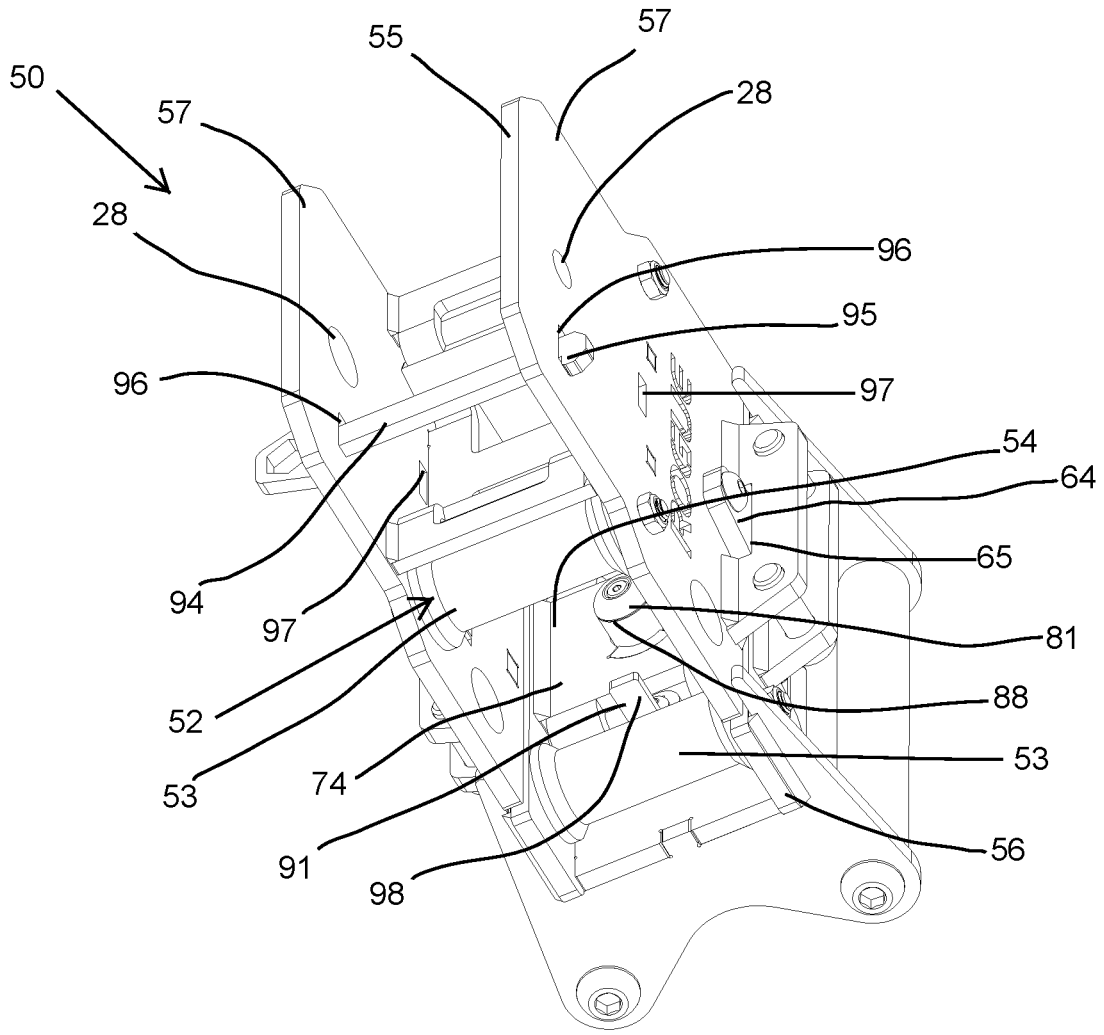
FIG. 9 is a bottom, front perspective view of the carriage assembly of FIG. 1.
Figure 10:
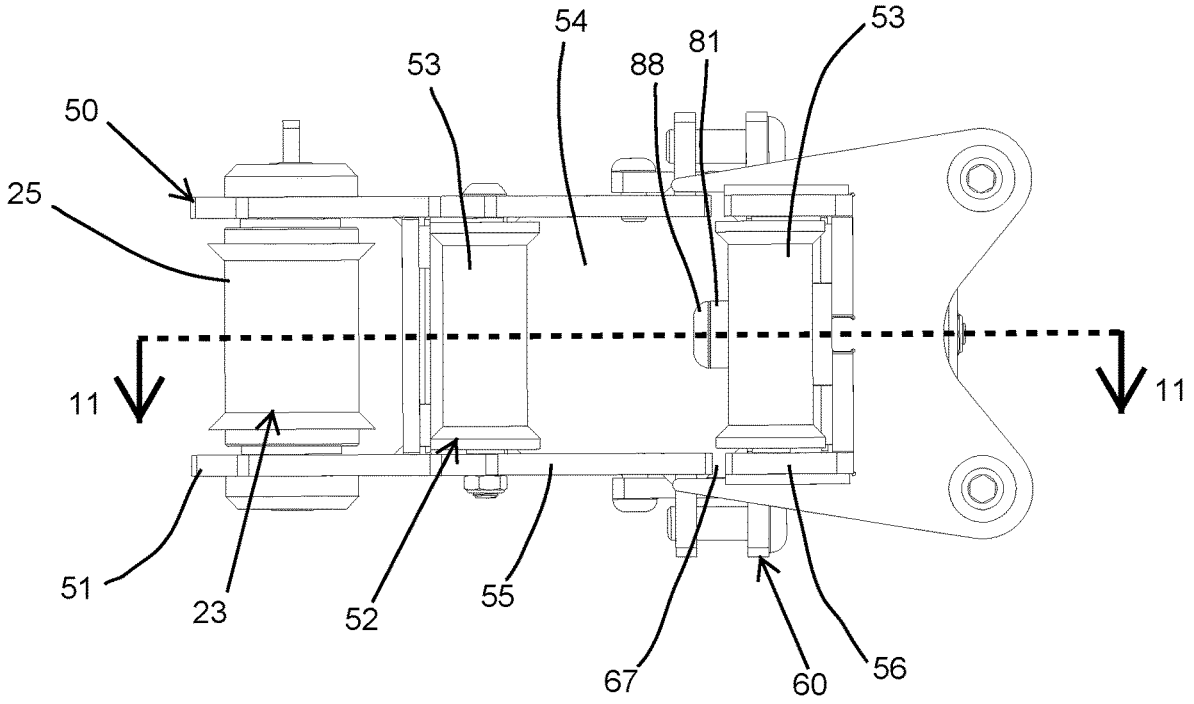
FIG. 10 is a top view of the carriage assembly of FIG. 1.
Figure 10A:
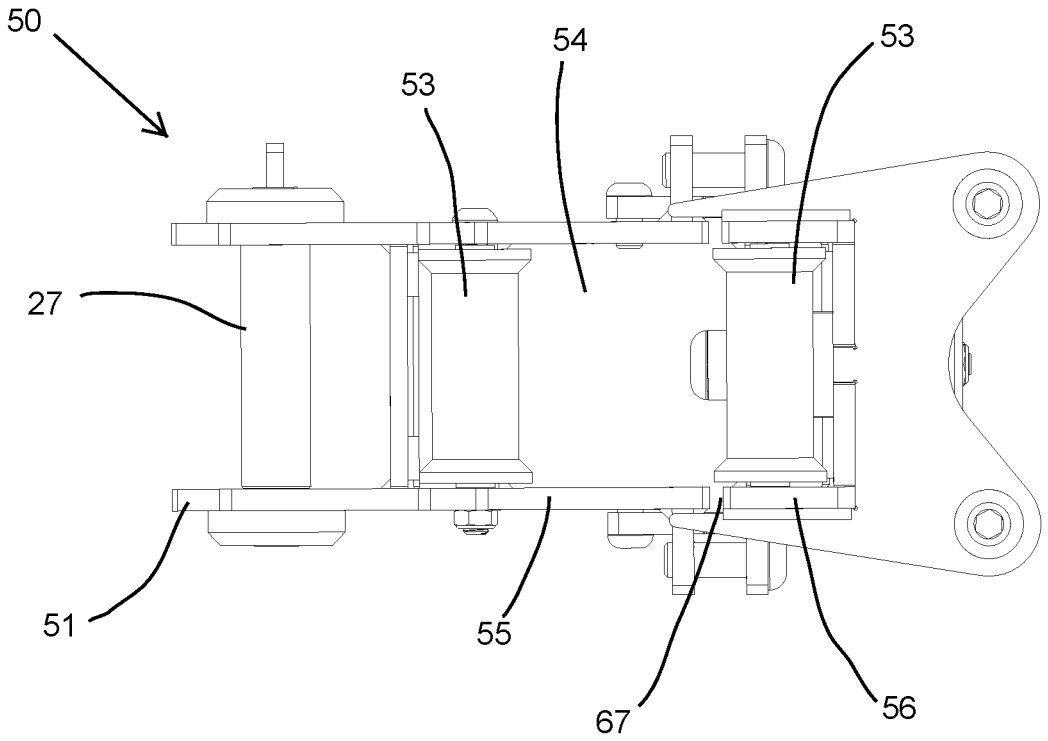
FIG. 10A is a top view of the carriage assembly of FIG. 1, shown without a bushing structure.

The carriage assembly 50 in FIGS. 1-11 is configured for connection to an implement 20 in a pivoting or articulating configuration, such that the implement 20 or a portion thereof can pivot or articulate with respect to the carriage assembly 50, as shown in FIGS. 12-13. Various embodiments of implements 20 can be used in connection with the carriage assembly 50, including non-articulating implements. In one embodiment, the implement 20 may be a weightlifting arm 21 as shown in FIGS. 12-13. The carriage assembly 50 and the implement 20 have connection structure 23 for connecting the implement 20 to the carriage assembly. In the embodiment of FIGS. 1-13, the connection structure 23 includes a pivot pin 27 (FIGS. 10A-11) inserted through a passage 24 in the arm 21, and fasteners (e.g., bolts) 26 are inserted into the pivot pin 27 to mount the implement 20 on the carriage assembly 50 (see FIG. 13). The pivot pin 27 in this embodiment extends through a bushing structure 25 that is mounted in the passage 24 of the arm 21. The bushing structure 25 is shown connected to the pivot pin 27 in some of FIGS. 1-11. As illustrated in FIG. 9, the side plates 57 have openings 28 for connection of the pivot pin 27, and the opening 28 in one of the side plates 57 of the carriage assembly 50 is larger (the left opening 28 in FIG. 9) than the opening 28 in the other side plate 57 (the right opening 28 in FIG. 9). In this configuration, the entire pivot pin 27 can be inserted through the larger opening 28, and the end of the pin 27 abuts the inner surface of the opposite side plate 57. A washer 29 is fitted over the larger opening 28 to abut the other end of the pin 27. The arm 21 may further be configured for connection of accessories for specific functionality, and the holes 13 may be used for connection of such accessories. Examples of such accessories are shown and described in U.S. patent application Ser. No. 16/294,664, filed Mar. 6, 2019, which is incorporated by reference herein.

The carriage assembly 50 further includes a locking key 94 that extends through and engages both side plates 57 of the carriage 51 and the arm 21 to lock the arm 21 in the downward vertical position, as shown in FIGS. 12-13. The side plates 57 have holes 96 to receive the key 94 therethrough, and the key 94 is received through ordinary holes 13 in the arm 21. The key 94 has a hook or other engaging structure 95 at one end to engage the side plate 57, and the key 94 extends through one of the holes in the arm 21 to prevent significant articulating movement of the arm 21. When not in use, the key 94 can be inserted through additional holes 97 in the side plates 57 that are located in a position that does not result in engagement of the arm 21 and does not otherwise interfere with the use of the carriage assembly 50.

Figure 24:
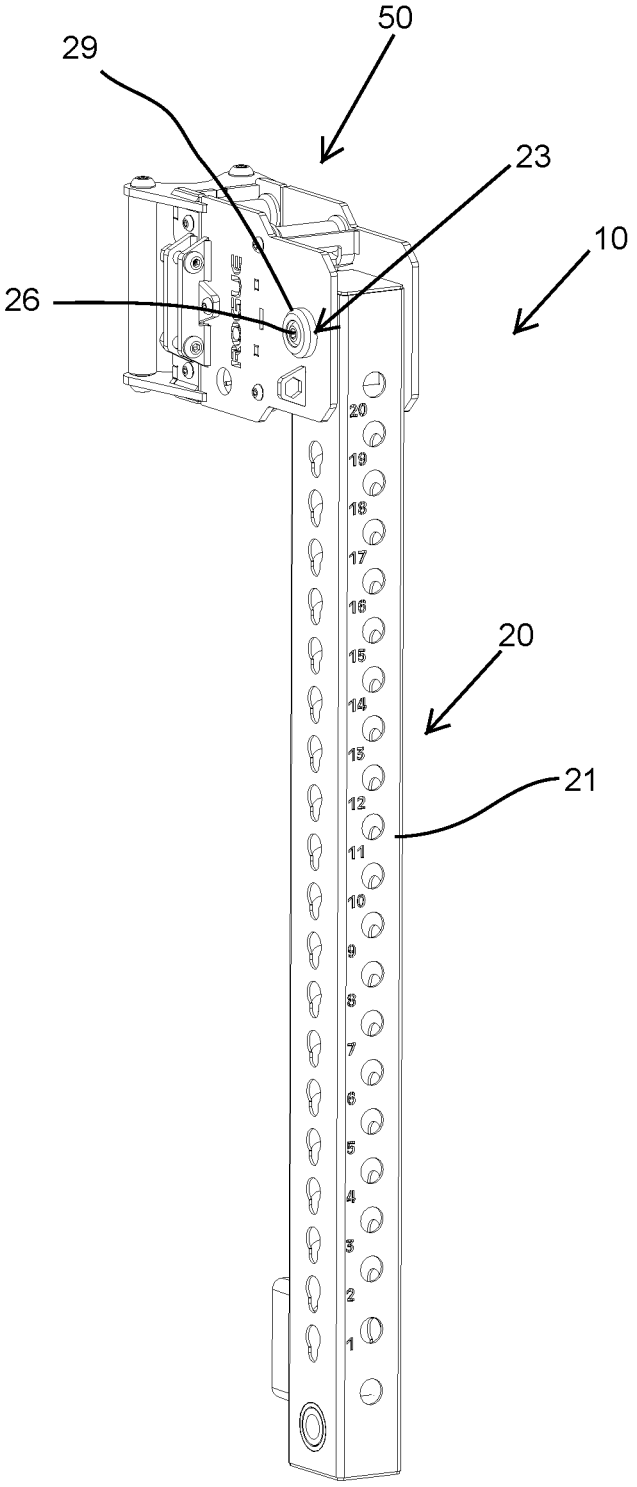
FIG. 24 is a perspective view of another embodiment of a weightlifting assembly including the carriage assembly of FIG. 14 with an implement connected thereto, according to aspects of the present disclosure.

FIGS. 14-23 illustrate another embodiment of a carriage assembly 50, and FIG. 24 illustrates another embodiment of a weightlifting assembly 10 that includes the carriage assembly 50 of FIGS. 14-23. The carriage assembly 50 in FIGS. 14-23 and the weightlifting assembly 10 in FIG. 24 include substantially all of the same features and functionality as the carriage assembly 50 and the weightlifting assembly disclosed herein with respect to FIGS. 1-13, and such features and functionality are not described again herein for the sake of brevity. These features are shown and identified with reference numbers in FIGS. 14-24. It is understood that the embodiment of FIGS. 14-24 may not only include any or all of the features and functionality described herein with respect to FIGS. 1-13, but any alternate or additional embodiments of such features and functionality described herein may also be used in connection with the embodiment of FIGS. 14-24. The carriage assembly 50 in FIGS. 1-13 is configured for use with a square beam, e.g., a 3×3 inch beam, whereas the carriage assembly 50 in FIGS. 14-24 is configured for use with a rectangular beam, e.g., a 4×3 inch beam. Likewise, the weightlifting arm 21 of the implement 20 in FIGS. 12-13 is a square (e.g., 3×3 inch) beam, and the weightlifting arm 21 of the implement 20 in FIG. 24 is a rectangular (e.g., 4×3 inch) beam.

Various embodiments of carriage assemblies and weightlifting assemblies have been described herein, which include various components and features. In other embodiments, the carriage assemblies and weightlifting assemblies may be provided with any combination of such components and features. For example, the locking structure 80 and the adjustment structure 60 may be used together or separately, i.e., either the locking structure 80 or the adjustment structure 60 may be used without the other. In one particular example, the locking structure 80 or the adjustment structure 60 may be incorporated into a carriage assembly as shown and described in U.S. patent application Ser. No. 16/294,664, filed Mar. 6, 2019, which is incorporated by reference herein. It is also understood that in other embodiments, the various devices, components, and features of the carriage assemblies and weightlifting assemblies described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. When used in description of a method or process, the term "providing" (or variations thereof) as used herein means generally making an article available for further actions, and does not imply that the entity "providing" the article manufactured, assembled, or otherwise produced the article. The term "approximately" as used herein implies a variation of up to 10% of the nominal value modified by such term, or up to 10% of a midpoint value of a range modified by such term. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. An adjustable carriage assembly comprising:

a carriage defining a passage configured to receive a frame member therethrough such that the carriage is moveable along the frame member; and a locking structure configured for engaging the frame member to lock the carriage in position relative to the frame member, wherein the locking structure comprises:

a main pin connected to the carriage that is moveable between a locked position, where the main pin extends into the passage and is configured to engage the frame member to lock the carriage in position, and an unlocked position, where the main pin is retracted from the passage and is configured to disengage from the frame member, the main pin having a first engagement member configured to be manipulated by a user to move the main pin between the locked position and the unlocked position; and an auxiliary pin connected to the carriage that is moveable between a locked position, where the auxiliary pin extends into the passage and is configured to engage the frame member to lock the carriage in position, and an unlocked position, where the auxiliary pin is retracted from the passage and is configured to disengage from the frame member, the auxiliary pin having a second engagement member configured to be manipulated by the user to move the auxiliary pin between the locked position and the unlocked position, wherein the first engagement member is immediately adjacent to the second engagement member, and wherein movement of both the main pin and the auxiliary pin to the unlocked positions allows movement of the carriage with respect to the frame member.

2. The adjustable carriage assembly of claim 1, wherein the locking structure further comprises:

a first collar piece having a proximal end connected to the carriage and receiving the main pin therethrough and a distal end opposite the proximal end; and a second collar piece connected to the distal end of the first collar piece, the second collar piece having a first opening receiving the main pin therethrough and a second opening receiving the auxiliary pin therethrough.

3. The adjustable carriage assembly of claim 2, wherein the locking structure further comprises:

a first biasing spring engaging the second collar piece and the main pin to bias the main pin toward the locked position; and a second biasing spring engaging the second collar piece and the auxiliary pin to bias the auxiliary pin toward the locked position.

4. The adjustable carriage assembly of claim 1, wherein the first engagement member has a first pair of grips extending from opposite lateral sides of the first engagement member, and the second engagement member has a second pair of grips extending from opposite lateral sides of the second engagement member.

5. The adjustable carriage assembly of claim 4, wherein each of the first pair of grips has a recess on a front side thereof, and each of the second pair of grips has a recess on a front side thereof.

6. The adjustable carriage assembly of claim 1, further comprising:

a handle assembly connected to the carriage and comprising a handle configured for gripping by the user.

7. The adjustable carriage assembly of claim 1, wherein at least one of the main pin and the auxiliary pin is biased toward the locked position.

8. The adjustable carriage assembly of claim 1, wherein the first engagement member is positioned above the second engagement member.

9. The adjustable carriage assembly of claim 1, wherein the first engagement member has a same shape as the second engagement member when viewed from above.

10. The adjustable carriage assembly of claim 1, further comprising:

a handle assembly connected to the carriage and comprising a first handle and a second handle configured for gripping by the user, wherein the first engagement member and the second engagement member are positioned between the first and second handles.

11. The adjustable carriage assembly of claim 1, wherein the main pin has a main pin end configured to engage the frame member within the passage, and the auxiliary pin has an auxiliary pin end configured to engage the frame member within the passage, and wherein the auxiliary pin has an offset configuration, such that auxiliary pin end and the main pin end are spaced farther apart than the first engagement member and the second engagement member.

12. The adjustable carriage assembly of claim 1, wherein the main pin has a main pin end, and the auxiliary pin has an auxiliary pin end, and wherein the auxiliary pin end has a smaller vertical profile than the main pin end.

13. An adjustable carriage assembly configured to be adjustably mounted on a vertical, rectangular frame member, having first, second, third, and fourth sides, comprising:

a carriage defining a passage configured to receive the frame member therethrough, such that the carriage is moveable along the frame member; and a locking structure configured for engaging the frame member to lock the carriage in position relative to the frame member, wherein the locking structure comprises:

a first pin connected to the carriage that is moveable between a locked position, where the first pin extends into the passage and has a first pin end configured to be received in a first hole on the first side of the frame member to lock the carriage in position, and an unlocked position, where the first pin end is retracted and is configured to be removed from the first hole; and a second pin connected to the carriage that is moveable between a locked position, where the second pin extends into the passage and has a second pin end configured to be received in a second hole on the first side of the frame member to lock the carriage in position, and an unlocked position, where the second pin is retracted and is configured to be removed from the second hole, and wherein the second pin end has a smaller vertical profile than the first pin end, wherein the first pin has a first engagement member configured to be manipulated by a user to move the first pin from the locked position to the unlocked position, and the second pin has a second engagement member configured to be manipulated by the user to move the second pin from the locked position to the unlocked position, and wherein the first engagement member is positioned immediately adjacent to the second engagement member, wherein movement of both the first pin and the second pin to the unlocked positions allows movement of the carriage with respect to the frame member.

14. The adjustable carriage assembly of claim 13, wherein the locking structure further comprises:

a first collar piece having a proximal end connected to the carriage and receiving the first pin therethrough and a distal end opposite the proximal end; and a second collar piece connected to the distal end of the first collar piece, the second collar piece having a first opening receiving the first pin therethrough and a second opening receiving the second pin therethrough.

15. The adjustable carriage assembly of claim 14, wherein the locking structure further comprises:

a first biasing spring engaging the second collar piece and the first pin to bias the first pin toward the locked position; and a second biasing spring engaging the second collar piece and the second pin to bias the second pin toward the locked position.

16. The adjustable carriage assembly of claim 13, wherein at least one of the first pin and the second pin is biased toward the locked position.

17. The adjustable carriage assembly of claim 13, further comprising:

a handle assembly connected to the carriage and comprising a handle configured for gripping by the user.

18. The adjustable carriage assembly of claim 13, wherein the first engagement member is positioned above the second engagement member.

19. The adjustable carriage assembly of claim 13, wherein the first engagement member has a same shape as the second engagement member when viewed from above.

20. The adjustable carriage assembly of claim 13, further comprising:

a handle assembly connected to the carriage and comprising a first handle and a second handle configured for gripping by the user, wherein the first engagement member and the second engagement member are positioned between the first and second handles.

21. An adjustable carriage assembly configured to be adjustably mounted on a vertical, rectangular frame member having first, second, third, and fourth sides, comprising:

a carriage defining a passage configured to receive the frame member therethrough, such that the carriage is moveable along the frame member; and a locking structure configured for engaging the frame member to lock the carriage in position relative to the frame member, wherein the locking structure comprises:

a first pin connected to the carriage that is moveable between a locked position, where the first pin extends into the passage and is configured to be received in a first hole on the first side of the frame member to lock the carriage in position, and an unlocked position, where the first pin is retracted from the passage and is configured to be removed from the first hole; and a second pin connected to the carriage that is moveable between a locked position, where the second pin extends into the passage and is configured to be received in a second hole on the first side of the frame member, located below the first hole, to lock the carriage in position, and an unlocked position, where the second pin is retracted from the passage and is configured to be removed from the second hole, wherein movement of both the first pin and the second pin to the unlocked positions allows movement of the carriage with respect to the frame member, wherein the first pin has a first engagement member configured to be manipulated by a user to move the first pin from the locked position to the unlocked position, and the second pin has a second engagement member configured to be manipulated by the user to move the second pin from the locked position to the unlocked position, wherein the first pin has a first pin end configured to be received in the first hole, and the second pin has a second pin end configured to be received in the second hole, and wherein the second pin has an offset configuration, such that second pin end and the first pin end are spaced farther apart than the first engagement member and the second engagement member.

22. An adjustable carriage assembly comprising:

a carriage defining a passage configured to receive a frame member therethrough such that the carriage is moveable along the frame member;

a handle assembly connected to the carriage and comprising a first handle configured for gripping by a first hand of a user and a second handle configured for gripping by a second hand of the user; and a locking structure configured for engaging the frame member to lock the carriage in position relative to the frame member, wherein the locking structure comprises:

a main pin connected to the carriage that is moveable between a locked position, where the main pin extends into the passage and is configured to engage the frame member to lock the carriage in position, and an unlocked position, where the main pin is retracted from the passage and is configured to disengage from the frame member, wherein the main pin is biased toward the locked position, the main pin having a first engagement member configured to be manipulated by a user to move the main pin from the locked position to the unlocked position; and an auxiliary pin connected to the carriage that is moveable between a locked position, where the auxiliary pin extends into the passage and is configured to engage the frame member to lock the carriage in position, and an unlocked position, where the auxiliary pin is retracted from the passage and is configured to disengage from the frame member, wherein the auxiliary pin is biased toward the locked position, the auxiliary pin having a second engagement member configured to be manipulated by the user to move the auxiliary pin from the locked position to the unlocked position, wherein the first engagement member and the second engagement member are immediately adjacent to each other and positioned to be engageable simultaneously by at least one of the first and second hands of the user while the user is gripping the first and second handles, and wherein movement of both the main pin and the auxiliary pin to the unlocked positions allows movement of the carriage with respect to the frame member.

23. The adjustable carriage assembly of claim 22, wherein the first engagement member is positioned above the second engagement member.

24. The adjustable carriage assembly of claim 23, wherein the first engagement member has a first pair of grips extending from opposite lateral sides of the first engagement member, and the second engagement member has a second pair of grips extending from opposite lateral sides of the second engagement member.

25. The adjustable carriage assembly of claim 24, wherein each of the first pair of grips has a recess on a front side thereof, and each of the second pair of grips has a recess on a front side thereof.

26. The adjustable carriage assembly of claim 24, wherein the first engagement member has a same shape as the second engagement member when viewed from above.

27. The adjustable carriage assembly of claim 22, wherein the locking structure further comprises:

a first collar piece having a proximal end connected to the carriage and receiving the main pin therethrough and a distal end opposite the proximal end; and a second collar piece connected to the distal end of the first collar piece, the second collar piece having a first opening receiving the main pin therethrough and a second opening receiving the auxiliary pin therethrough.

28. The adjustable carriage assembly of claim 27, wherein the locking structure further comprises:

a first biasing spring engaging the second collar piece and the main pin to bias the main pin toward the locked position; and a second biasing spring engaging the second collar piece and the auxiliary pin to bias the auxiliary pin toward the locked position.

29. The adjustable carriage assembly of claim 22, wherein the first engagement member is positioned immediately adjacent to the second engagement member.

30. An adjustable carriage assembly comprising:

a carriage defining a configured to receive a frame member therethrough such that the carriage is moveable along the frame member, a handle assembly connected to the carriage and comprising a first handle configured for gripping by a first hand of a user and a second handle configured for gripping by a second hand of the user; and a locking structure configured for engaging the frame member to lock the carriage in position relative to the frame member, wherein the locking structure comprises:

a main pin connected to the carriage that is moveable between a locked position, where the main pin extends into the passage and is configured to engage the frame member to lock the carriage in position, and an unlocked position, where the main pin is retracted from the passage and is configured to disengage from the frame member, wherein the main pin is biased toward the locked position, the main pin having a first engagement member configured to be manipulated by a user to move the main pin from the locked position to the unlocked position; and an auxiliary pin connected to the carriage that is moveable between a locked position, where the auxiliary pin extends into the passage and is configured to engage the frame member to lock the carriage in position, and an unlocked position, where the auxiliary pin is retracted from the passage and is configured to disengage from the frame member, wherein the auxiliary pin is biased toward the locked position the auxiliary pin having a second engagement member configured to be manipulated by the user to move the auxiliary pin from the locked position to the unlocked position, wherein the first engagement member and the second engagement member are positioned to be engageable simultaneously by at least one of the first and second hands of the user while the user is gripping the first and second handles, wherein movement of both the main pin and the auxiliary pin to the unlocked positions allows movement of the carriage with respect to the frame member, and wherein the main pin has a main pin end configured to engage the frame member within the passage, and the auxiliary pin has an auxiliary pin end configured to engage the frame member within the passage, and wherein the auxiliary pin has an offset configuration, such that auxiliary pin end and the main pin end are spaced farther apart than the first engagement member and the second engagement member.

31. The adjustable carriage assembly of claim 22, wherein the main pin has a main pin end, and the auxiliary pin has an auxiliary pin end, and wherein the auxiliary pin end has a smaller vertical profile than the main pin end.

* * * * *